US010196170B2

(12) United States Patent
Gasior

(10) Patent No.: US 10,196,170 B2
(45) Date of Patent: Feb. 5, 2019

(54) REINFORCED PACKING CONTAINER

(71) Applicant: GEORGIA-PACIFIC CORRUGATED LLC, Atlanta, GA (US)

(72) Inventor: Wayne P. Gasior, Duluth, GA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 68 days.

(21) Appl. No.: 13/737,659

(22) Filed: Jan. 9, 2013

(65) Prior Publication Data

US 2013/0126594 A1 May 23, 2013

Related U.S. Application Data

(63) Continuation-in-part of application No. 13/224,734, filed on Sep. 2, 2011, now Pat. No. 8,851,362.

(60) Provisional application No. 61/379,808, filed on Sep. 3, 2010.

(51) Int. Cl.

| | |
|---|---|
| ***B65D 5/44*** | (2006.01) |
| ***B65D 5/02*** | (2006.01) |
| ***B65D 5/42*** | (2006.01) |

(52) U.S. Cl.

CPC ..... *B65D 5/443* (2013.01); *B65D 5/0227* (2013.01); *B65D 5/4266* (2013.01)

(58) Field of Classification Search

USPC ..... 229/100, 198.2, 930–931, 190, 194–197, 229/188, 122.29, 125, 148

See application file for complete search history.

(56) References Cited

U.S. PATENT DOCUMENTS

| | | | |
|---|---|---|---|
| 272,327 | A | 2/1883 | Rogers |
| 981,993 | A | 1/1911 | Gair et al. |
| 1,892,594 | A | 12/1932 | Stone |
| 2,082,365 | A | 6/1937 | Straw et al. |

(Continued)

FOREIGN PATENT DOCUMENTS

| | | | |
|---|---|---|---|
| CL | 199400362 | A | 5/1995 |
| CL | 199501348 | A | 6/1996 |

(Continued)

OTHER PUBLICATIONS

PCT Search Report and Written Opinion for PCT/US2014/010587 dated May 14, 2014.

(Continued)

*Primary Examiner* — Christopher Demeree

(57) ABSTRACT

A container has a plurality of panels integrally arranged with respect to a set of orthogonal x, y and z axes, the z-axis defining a direction line in which the container is configured to support a stacking load. The panels are folded to define a form having a plurality of folded edges oriented perpendicular to the z-axis. At least one of the plurality of folded edges has a cutout region having a planar edge oriented perpendicular to the z-axis. The plurality of panels includes a plurality of cut edges oriented and disposed inline with respective ones of the plurality of folded edges. At least one of the plurality of cut edges has a projection disposed contiguous and planar with a respective panel. The projection includes a planar edge oriented perpendicular to the z-axis, the planar edge being disposed within an adjacently disposed cutout region.

11 Claims, 18 Drawing Sheets

(56) References Cited

U.S. PATENT DOCUMENTS

| | | | | |
|---|---|---|---|---|
| 2,114,052 | A | 4/1938 | Kincade, Jr. | |
| 2,300,492 | A | 11/1942 | Fischer | |
| 2,346,488 | A | 4/1944 | Hoffmaster et al. | |
| 2,367,717 | A | 4/1951 | Stevens | |
| 2,547,892 | A | 4/1951 | Stevens | |
| 2,811,296 | A * | 10/1957 | Long | 229/117.16 |
| 2,839,236 | A * | 6/1958 | Dunning | 229/145 |
| 2,857,090 | A | 10/1958 | Fallert | |
| 2,887,389 | A | 5/1959 | Linville | |
| 2,962,202 | A | 11/1960 | Hansen | |
| 3,017,064 | A | 1/1962 | Davis | |
| 3,100,072 | A | 8/1963 | Mason | |
| 3,163,344 | A | 12/1964 | Tunick | |
| 3,164,316 | A | 1/1965 | Wurster et al. | |
| 3,202,339 | A | 8/1965 | Franklin, Jr. | |
| 3,206,099 | A | 9/1965 | Fanter et al. | |
| 3,217,924 | A | 11/1965 | Chidsey, Jr. | |
| 3,265,285 | A | 8/1966 | Fanter | |
| 3,309,005 | A | 3/1967 | Pilger | |
| 3,353,740 | A | 11/1967 | Outwater | |
| 3,375,967 | A * | 4/1968 | Robinson | 229/178 |
| 3,447,735 | A | 6/1969 | Whitney | |
| 3,481,527 | A | 12/1969 | Jacke | |
| 3,552,633 | A | 1/1971 | Ketler | |
| 3,688,972 | A | 9/1972 | Mahon | |
| 3,698,548 | A | 10/1972 | Stenzel et al. | |
| 3,744,705 | A * | 7/1973 | Kuhn et al. | 229/148 |
| 3,747,801 | A | 7/1973 | Graser | |
| 3,826,421 | A | 7/1974 | Morse et al. | |
| 3,883,067 | A | 5/1975 | McGlynn | |
| 3,899,123 | A | 8/1975 | Stollberg et al. | |
| 3,963,170 | A | 6/1976 | Wood | |
| 4,029,207 | A | 6/1977 | Gordon | |
| 4,042,166 | A * | 8/1977 | Selin et al. | 229/154 |
| 4,056,223 | A | 11/1977 | Williams | |
| 4,084,693 | A | 4/1978 | Culpepper | |
| 4,093,116 | A | 6/1978 | Watkins et al. | |
| 4,256,226 | A | 3/1981 | Stone | |
| 4,267,959 | A | 5/1981 | Gilbert | |
| 4,283,001 | A | 8/1981 | Meyers | |
| 4,572,423 | A | 2/1986 | Spencer | |
| 4,644,586 | A | 2/1987 | Padgett | |
| 4,702,407 | A | 10/1987 | Lisiecki | |
| 4,771,939 | A | 9/1988 | Wilkins | |
| 4,850,527 | A | 7/1989 | Church et al. | |
| 5,002,224 | A | 3/1991 | Muise | |
| 5,085,367 | A | 2/1992 | Carstens | |
| 5,117,973 | A | 6/1992 | LoDuca | |
| D337,270 | S | 7/1993 | Brockman | |
| 5,323,957 | A | 6/1994 | Roosa | |
| 5,335,844 | A | 8/1994 | Young | |
| 5,392,985 | A * | 2/1995 | Smith et al. | 229/125 |
| 5,400,955 | A | 3/1995 | Coalier et al. | |
| 5,427,242 | A | 6/1995 | Oliff et al. | |
| 5,450,998 | A | 9/1995 | Esse et al. | |
| 5,474,232 | A | 12/1995 | Ljungstrom et al. | |
| 5,535,941 | A | 7/1996 | Garza | |
| 5,662,508 | A | 9/1997 | Smith | |
| 5,671,883 | A | 9/1997 | Philips | |
| 5,690,601 | A | 11/1997 | Cummings et al. | |
| 5,755,377 | A | 5/1998 | Durand | |
| 5,772,110 | A | 6/1998 | Garretson | |
| 5,839,650 | A | 11/1998 | Sheffer | |
| 5,918,801 | A | 7/1999 | Milio | |
| 5,950,912 | A | 9/1999 | Economopoulos | |
| 5,957,294 | A | 9/1999 | Kanter | |
| 6,098,874 | A | 8/2000 | Tokarski | |
| 6,132,349 | A | 10/2000 | Yokoyama | |
| 6,247,593 | B1 | 6/2001 | Ruble et al. | |
| 6,640,975 | B2 | 11/2003 | Bennett et al. | |
| 6,660,368 | B2 * | 12/2003 | Cooley | 428/195.1 |
| 6,834,793 | B2 | 12/2004 | Sutherland | |
| 6,866,186 | B2 | 3/2005 | Fogle et al. | |
| 6,935,504 | B2 | 8/2005 | Ritter et al. | |
| 7,124,890 | B2 | 10/2006 | McLeod et al. | |
| 7,201,714 | B2 | 4/2007 | Zoeckler et al. | |
| 7,261,231 | B2 | 8/2007 | Kuhn et al. | |
| 7,628,311 | B2 | 12/2009 | Kuhn et al. | |
| 7,673,787 | B2 * | 3/2010 | Mittelstaedt | 229/117.16 |
| 7,766,219 | B2 | 8/2010 | Gomes et al. | |
| 8,690,047 | B2 | 4/2014 | McKenna et al. | |
| 2002/0008134 | A1 | 1/2002 | Southwell | |
| 2003/0168452 | A1 | 9/2003 | Prutkin et al. | |
| 2003/0234285 | A1 | 12/2003 | Bates et al. | |
| 2005/0189405 | A1 | 9/2005 | Gomes et al. | |
| 2005/0236466 | A1 | 10/2005 | McLeod | |
| 2005/0279815 | A1 | 12/2005 | Fogle et al. | |
| 2006/0196920 | A1 * | 9/2006 | Moen | 229/122.24 |
| 2007/0000986 | A1 | 1/2007 | McClure | |
| 2007/0063005 | A1 | 3/2007 | Gomes et al. | |
| 2007/0138244 | A1 * | 6/2007 | England | 229/125.32 |
| 2007/0152027 | A1 | 7/2007 | Hyatt et al. | |
| 2009/0095799 | A1 | 4/2009 | Garner | |
| 2009/0121003 | A1 | 5/2009 | Garner | |
| 2009/0121006 | A1 | 5/2009 | Gasior | |
| 2009/0286663 | A1 | 11/2009 | Little et al. | |
| 2010/0219232 | A1 | 9/2010 | Smith | |
| 2010/0264049 | A1 | 10/2010 | Maillot | |
| 2011/0204127 | A1 | 8/2011 | Brundage et al. | |
| 2011/0204131 | A1 | 8/2011 | Brundage et al. | |
| 2011/0281705 | A1 | 11/2011 | Aganovic et al. | |
| 2012/0000973 | A1 | 1/2012 | McLeod | |
| 2012/0055922 | A1 | 3/2012 | Askan et al. | |
| 2012/0061456 | A1 | 3/2012 | Rosas et al. | |
| 2013/0048704 | A1 | 2/2013 | Lewis et al. | |
| 2014/0174977 | A1 | 6/2014 | McKenna et al. | |
| 2016/0068298 | A1 | 3/2016 | Westney et al. | |

FOREIGN PATENT DOCUMENTS

| | | | | |
|---|---|---|---|---|
| CL | 199501794 | A | 9/1996 | |
| CL | 200001067 | A | 6/2001 | |
| DE | 1281342 | | 10/1968 | |
| DE | 3222017 | A1 | 12/1983 | |
| EP | 468860 | A1 | 1/1992 | |
| FR | 1284481 | A | 2/1962 | |
| GB | 2270678 | A * | 3/1994 | B65D 5/36 |
| GB | 2419345 | A | 4/2006 | |
| GB | 2436830 | A | 10/2007 | |
| KR | 20-1998-0067913 | | 12/1988 | |
| KR | 20-2008-0006523 | | 12/2008 | |
| KR | 10-2010-0052013 | | 5/2010 | |
| NL | 9301699 | A | 5/1995 | |
| WO | 93/03967 | | 3/1993 | |
| WO | 0068098 | | 11/2000 | |
| WO | 01/66423 | A1 | 9/2001 | |
| WO | 2006/026767 | A1 | 3/2006 | |
| WO | 2006/095097 | A2 | 9/2006 | |
| WO | 2010128874 | A1 | 11/2010 | |

OTHER PUBLICATIONS

PCT Search Report and Written Opinion of the International Search Authority for PCT/US2011/050347 dated Mar. 19, 2012.

European Patent Office, Extended European Search Report for 11822726.3, dated Jun. 2, 2015, six pages, Munich, Germany.

Extended European Search Report for Application No. 17159609.1-1708 dated Mar. 31, 2017; Report Received Dec. 5, 2017, which is related to U.S. Appl. No. 13/737,659; 1-9 pages.

* cited by examiner

Table – 1

| Column-1 | Column-2 | Column-3 | Column-4 |
|---|---|---|---|
| Term | Scaled Estimate | | Prob>\|t\| |
| Intercept | 539.4151 | | <.0001* |
| Length Configuration[33] | 20.66904 | | 0.0445* |
| Length Configuration[32] | -1.13248 | | 0.8936 |
| Length Configuration[22] | -8.659217 | | 0.3866 |
| Length Configuration[base] | -10.87734 | | 0.1925 |
| Width Configuration[33] | 14.264829 | | 0.1315 |
| Width Configuration[22] | -21.87716 | | 0.0128* |
| Width Configuration[base] | 7.6123337 | | 0.3078 |
| Tab Length[10%] | -3.906408 | | 0.4910 |
| Tab Length[20%] | 3.9064078 | | 0.4910 |
| Tab Height-Length Panel[+1/2 caliper] | -42.0137 | | <.0001* |
| Tab Height-Length Panel[0] | 12.61573 | | 0.1199 |
| Tab Height-Length Panel[-1/2 caliper] | 29.397971 | | 0.0015* |
| Tab Height-Width Panel[+1/2 caliper] | 8.7163634 | | 0.2634 |
| Tab Height-Width Panel[0] | 5.1870722 | | 0.4996 |
| Tab Height-Width Panel[-1/2 caliper] | -13.90344 | | 0.0890 |
| Corner Space[At corner] | 24.336455 | | 0.0008* |
| Corner Space[Evenly Spaced] | -24.33646 | | 0.0008* |
| | 0 | | <.0001* |
| Box Length[max-20 in] | 3.5177117 | | 0.5584 |
| Box Length[min-14 in] | -3.517712 | | 0.5584 |
| Box Width[max- 14 in] | 19.343052 | | 0.0057* |
| Box Width[min- 8 in] | -19.34305 | | 0.0057* |
| Box Height[max- 16 in] | 5.6966262 | | 0.2512 |
| Box Height[min 6.25 in] | -5.696626 | | 0.2512 |

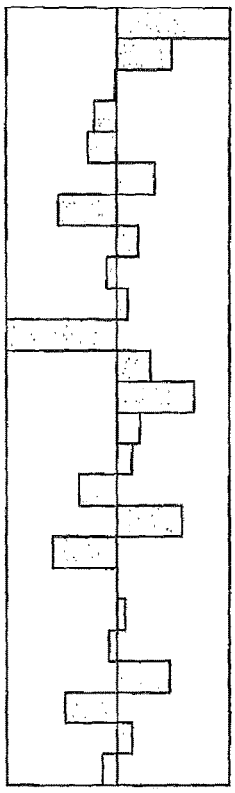

Fig. 16

Table – 2

| Column-1 | Column-2 | Column-3 | Column-4 |
|---|---|---|---|
| Term | Scaled Estimate | | Prob>\|t\| |
| Intercept | 1134.279 | | <.0001* |
| Length Configuration[33] | -13.43689 | | 0.5794 |
| Length Configuration[32] | -2.633495 | | 0.8984 |
| Length Configuration[22] | 7.1800077 | | 0.7670 |
| Length Configuration[base] | 8.8903779 | | 0.6779 |
| Width Configuration[33] | 28.056659 | | 0.2159 |
| Width Configuration[22] | 4.6369824 | | 0.8144 |
| Width Configuration[base] | -32.69364 | | 0.1541 |
| Tab Length[10%] | -24.85873 | | 0.1468 |
| Tab Length[20%] | 24.858728 | | 0.1468 |
| Tab Height-Length Panel[+1/2 caliper] | -43.24775 | | 0.0690 |
| Tab Height-Length Panel[0] | -20.58759 | | 0.3149 |
| Tab Height-Length Panel[-1/2 caliper] | 63.83534 | | 0.0069* |
| Tab Height-Width Panel[+1/2 caliper] | 8.3269766 | | 0.7521 |
| Tab Height-Width Panel[0] | 1.982915 | | 0.9161 |
| Tab Height-Width Panel[-1/2 caliper] | -10.30989 | | 0.6590 |
| Corner Space[At corner] | 9.4417152 | | 0.5432 |
| Corner Space[Evenly Spaced] | -9.441715 | | 0.5432 |
| | 0 | | <.0001* |
| Box Length[max-20 in] | 18.856477 | | 0.2543 |
| Box Length[min-14 in] | -18.85648 | | 0.2543 |
| Box Width[max- 14 in] | 82.183498 | | 0.0008* |
| Box Width[min- 8 in] | -82.1835 | | 0.0008* |
| Box Height[max- 16 in] | -19.41819 | | 0.1978 |
| Box Height[min 6.25 in] | 19.418188 | | 0.1978 |

Fig. 17

Table – 3

| Column-1 | Column-2 | Column-3 | Column-4 |
|---|---|---|---|
| Term | Scaled Estimate | | Prob>\|t\| |
| Intercept | 836.52175 | | <.0001* |
| Length Configuration[33] | 7.4755417 | | 0.6206 |
| Length Configuration[32] | 4.0294896 | | 0.7867 |
| Length Configuration[22] | -5.910084 | | 0.6795 |
| Length Configuration[base] | -5.594947 | | 0.6934 |
| Width Configuration[33] | 4.2873573 | | 0.7192 |
| Width Configuration[22] | -1.040452 | | 0.9312 |
| Width Configuration[base] | -3.246905 | | 0.7878 |
| Tab Length[10%] | -18.30369 | | 0.0376* |
| Tab Length[20%] | 18.30369 | | 0.0376* |
| Tab Height-Length Panel[+1/2 caliper] | -36.93731 | | 0.0041* |
| Tab Height-Length Panel[0] | -2.253309 | | 0.8513 |
| Tab Height-Length Panel[-1/2 caliper] | 39.19062 | | 0.0019* |
| Tab Height-Width Panel[+1/2 caliper] | -9.028906 | | 0.4637 |
| Tab Height-Width Panel[0] | 19.355386 | | 0.1145 |
| Tab Height-Width Panel[-1/2 caliper] | -10.32648 | | 0.3787 |
| Corner Space[At corner] | 19.886034 | | 0.0261* |
| Corner Space[Evenly Spaced] | -19.88603 | | 0.0261* |
| Board Combination[44C] | 299.89917 | | <.0001* |
| Board Combination[32B] | -299.8992 | | <.0001* |
| Box Length[max-20 in] | 16.725121 | | 0.0832 |
| Box Length[min-14 in] | -16.72512 | | 0.0832 |
| Box Width[max- 14 in] | 51.548987 | | <.0001* |
| Box Width[min- 8 in] | -51.54899 | | <.0001* |
| Box Height[max- 16 in] | -17.86503 | | 0.0404* |
| Box Height[min 6.25 in] | 17.865027 | | 0.0404* |

Fig. 18

REINFORCED PACKING CONTAINER

CROSS REFERENCE TO RELATED APPLICATIONS

This application is a continuation-in-part application of U.S. application Ser. No. 13/224,734, filed Sep. 2, 2011, which claims the benefit of U.S. Provisional Application Ser. No. 61/379,808, filed Sep. 3, 2010, both of which are incorporated herein by reference in their entireties.

BACKGROUND OF THE INVENTION

The subject matter disclosed herein relates to containers, particularly to packing containers, and more particularly to packing containers suitably configured for stacking one on top of another.

Packing containers are often formed from a corrugated sheet product material that is cut with a die to form a flat blank, or scored and slotted to form a knock down (KD). The flat blank or KD is folded into a three dimensional container that may be secured using an arrangement of flaps, adhesive liquids, adhesive tapes, or mechanical fasteners.

In use, packing containers may be subjected to considerable forces during shipping, storage and stacking. It is desirable to increase the strength and rigidity of packing containers, particularly with respect to stacking, while reducing the amount of materials used to form the packing containers.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

According to an embodiment of the invention, a container includes a plurality of panels integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the first panel and the second panel form a contiguity with a fold line disposed therebetween, and wherein the first planar surface is disposed parallel to the x-z plane or the y-z plane. The container further includes a compression reinforcement feature having a planar edge oriented orthogonal to the first planar surface and perpendicular to the z-axis, the planar edge being disposed a distance away from the fold line but at a distance no greater than half a thickness of the first panel, the first panel having a void between the fold line and the planar edge.

According to an embodiment of the invention, a container includes a plurality of panels having a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel. The first side panel and a first portion of the top panel form a contiguity with a first fold line disposed therebetween. The second side panel and a second portion of the top panel form a contiguity with a second fold line disposed therebetween. A first compression reinforcement feature is disposed proximate the first fold line and proximate the first end panel. A second compression reinforcement feature is disposed proximate the first fold line and proximate the second end panel. A third compression reinforcement feature is disposed proximate the second fold line and proximate the first end panel. A fourth compression reinforcement feature is disposed proximate the second fold line and proximate the second end panel. Each of the first and second compression reinforcement features have a planar edge oriented orthogonal to the first side panel and perpendicular to the z-direction, each respective planar edge being disposed a distance away from the first fold line but at a distance no greater than half a thickness of the first panel, the first panel having a void between the first fold line and each respective planar edge. Each of the third and fourth compression reinforcement features have a planar edge oriented orthogonal to the second side panel and perpendicular to the z-direction, each respective planar edge being disposed a distance away from the second fold line but at a distance no greater than half a thickness of the second panel, the second panel having a void between the second fold line and each respective planar edge.

According to an embodiment of the invention, a container includes a plurality of panels integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the first panel and the second panel form a contiguity with a fold line disposed therebetween, wherein the first planar surface is disposed parallel to the x-z plane or the y-z plane, and wherein the second panel is disposed orthogonal to the first panel. The container also includes a compression reinforcement feature having a planar edge oriented orthogonal to the first planar surface and perpendicular to the z-axis, the compression reinforcement feature includes a tab that extends from and is coplanar with the first panel and that terminates at the planar edge, the planar edge being disposed a distance away from a planar outer surface of the second panel but at a distance no greater than half a thickness of the first panel. The plurality of panels further comprises a third panel adhered to the outer surface of the second panel proximate the tab.

According to an embodiment of the invention, a container includes a plurality of panels having a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel. The first side panel and a first portion of the top panel form a contiguity with a first fold line disposed therebetween. The first side panel and a first portion of the bottom panel form a contiguity with a second fold line disposed therebetween. A first compression reinforcement feature is disposed proximate the first fold line and proximate the first end panel. A second compression reinforcement feature is disposed proximate the first fold line and proximate the second end panel. A third compression reinforcement feature is disposed proximate the second fold line and proximate the first end panel. A fourth compression reinforcement feature is disposed proximate the second fold line and proximate the second end panel. Each of the first and second compression reinforcement features have a planar edge oriented orthogonal to the first side panel and perpendicular to the z-direction, each of the first and second compression reinforcement features include a tab that extends from and is coplanar with the first side panel and that terminates at a respective planar edge, each respective planar edge being disposed a distance away from an outer surface of the top panel but at a distance no greater than half a thickness of the first panel. Each of the third and fourth compression reinforcement features have a planar edge oriented orthogonal to the first side panel and perpendicular to the z-direction, each respective planar edge of the third and fourth compression reinforcement features being disposed a distance away from the second fold line but at a distance no greater than half a thickness of the first side panel, the first side panel includes a void between the second fold line and each respective planar edge of the third and fourth compression reinforcement features.

According to an embodiment of the invention, a flat blank includes a first panel and a second panel that form a contiguity with a fold line disposed therebetween. The flat blank also includes a compression reinforcement feature formed by a cut line that begins at a first point on the second panel, traverses a first distance along a first line that extends across the fold line, traverses a second distance along a second line that runs substantially parallel to the fold line, and traverses a third distance along a third line that extends back across the fold line to end at a second point on the second panel, wherein the second line defines a location of a planar edge of the compression reinforcement feature, and wherein the planar edge is disposed a distance away from the fold line but at a distance no greater than half a thickness of the first panel.

According to an embodiment of the invention, a flat blank includes a first panel and a second panel that form a contiguity with a fold line disposed therebetween. The flat blank also includes a compression reinforcement feature formed by a cut line that begins at a first point on the first panel, traverses a first distance along a first line that extends across the fold line, traverses a second distance along a second line that runs substantially parallel to the fold line, and traverses a third distance along a third line that extends back across the fold line to end at a second point on the first panel, wherein the second line defines a location of a planar edge of the compression reinforcement feature, and wherein the planar edge is disposed a distance away from the fold line but at a distance no greater than a full thickness of the first panel.

According to an embodiment of the invention, a container includes a first panel comprising a planar surface, a second panel comprising a planar surface, wherein the first panel and the second panel form a contiguity with a fold line disposed therebetween, and a tabular region extending from the first panel, the tabular region arranged proximate to the fold line and coplanar with the planar surface of the first panel.

According to an embodiment of the invention, a container includes a bottom panel, a top panel opposing the bottom panel, a first side panel, a second side panel opposing the first side panel, a front panel, a rear panel opposing the front panel, and a first tabular region extending from the first side panel arranged coplanar with a planar surface of the first side panel.

According to an embodiment of the invention, a flat blank includes a first panel comprising a planar surface, a second panel comprising a planar surface, wherein the first panel and the second panel form a contiguity with a fold line disposed therebetween, and a tabular region defined by a cut line in the first panel.

According to an embodiment of the invention, a container includes a first panel comprising a planar surface, a second panel comprising a planar surface, wherein the first panel and the second panel form a contiguity with a fold line disposed therebetween, and a cut-out region of the second panel, the cut-out region partially defined by the fold line, a exposed edge of the first panel, the exposed edge partially defined by the cut-out region.

Another embodiment of the invention includes a container having a plurality of panels with a defined thickness integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the second panel is disposed adjacent the first panel, wherein the first panel and the second panel form a contiguity with a fold line disposed therebetween, wherein the first planar surface is disposed parallel to the x-z plane or the y-z plane, wherein the fold line has at least one cutout region having a first dimension that extends along the fold line and a second dimension that extends across the fold line from the first planar surface to the second planar surface, and wherein the at least one cutout region has a first planar edge oriented perpendicular to the first planar surface and perpendicular to the z-axis. The plurality of panels further include a third panel having a third planar surface disposed parallel with the first planar surface, wherein the third panel has an outer edge having at least one projection that is contiguous and planar with the third planar surface, and wherein the at least one projection has a second planar edge oriented perpendicular to the third planar surface and perpendicular to the z-axis. The at least one projection is disposed within a respective one of the at least one cutout region.

Another embodiment of the invention includes a container having a plurality of panels with a defined thickness integrally arranged with respect to each other and with respect to a set of orthogonal x, y and z axes, the z-axis defining a direction line in which the container is configured to support a stacking load. The plurality of panels is folded to define a form having a plurality of folded edges oriented perpendicular to the z-axis. At least one of the plurality of folded edges has a cutout region having a planar edge oriented perpendicular to the z-axis. The plurality of panels includes a plurality of cut edges oriented and disposed inline with respective ones of the plurality of folded edges. At least one of the plurality of cut edges has a projection disposed contiguous and planar with a respective panel of the plurality of panels. The projection includes a planar edge oriented perpendicular to the z-axis, the planar edge being disposed within an adjacently disposed cutout region.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying non-limiting drawings wherein like elements are numbered alike in which:

FIG. 16 depicts Table-1 that provides DOE box compression test (BCT) scaled estimates for a container made from lightweight fluted containerboard having B-flute and a minimum edgewise compression test specification of 32 lbs/inch.

FIG. 17 depicts Table-2 that provides DOE BCT scaled estimates similar to those of Table-1, but for a container made from heavyweight fluted containerboard having C-flute and a minimum edgewise compression test specification of 44 lbs/inch.

FIG. 18 depicts Table-3 that provides DOE BCT scaled estimates similar to those of Tables-1 and 2, except that it combines the data from Tables-1 and 2, hence the additional entries of "Board Combination [44C]" and "Board Combination [32B]" in Column-1.

Figure 1:
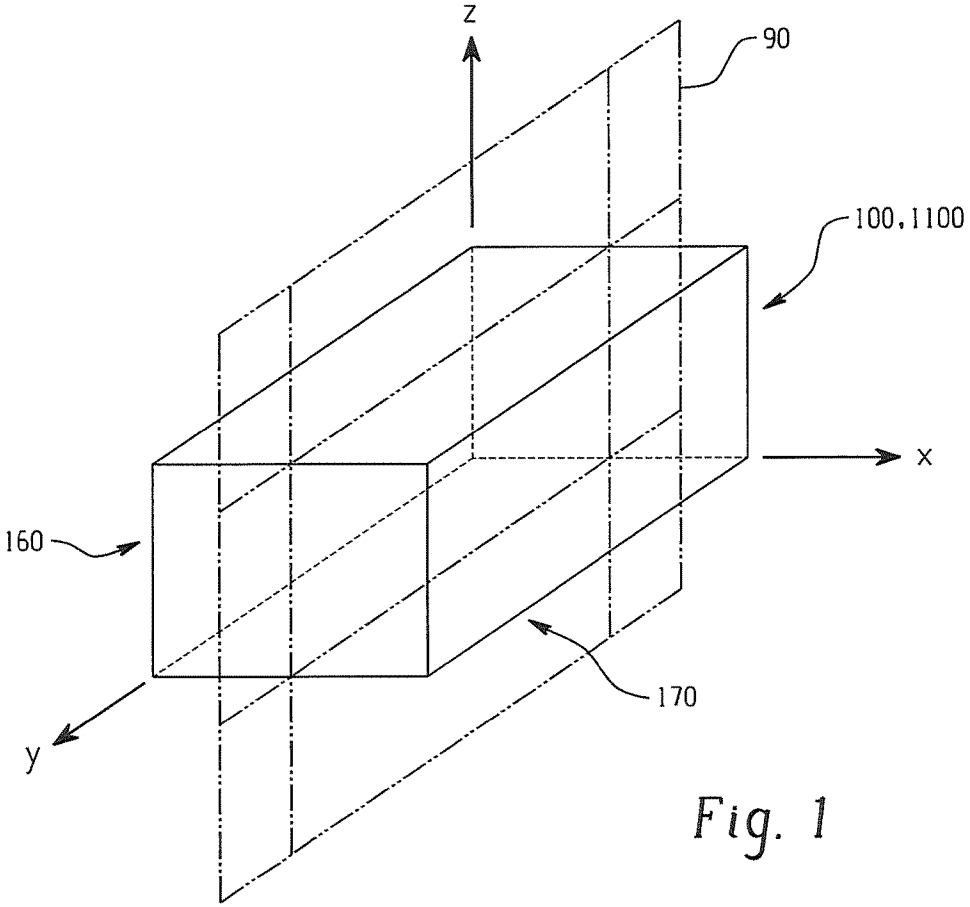
FIG. 1 illustrates a perspective view of a container relative to x, y and z axes, and a cutting plane that bisects the container lengthwise.

The detailed description explains embodiments of the invention, together with advantages and features, by way of example with reference to the drawings.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

A packing container, also referred to as a carton or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, adhesive liquids, tapes or mechanical means such as staples or straps to form a three dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), airlaid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or microflute, for example.

In use, a packing container may be subjected to various forces during handling, shipping and stacking of the packing container including, for example, compressive forces exerted between the top and bottom panels of the container. It is desirable for a packing container to withstand the various forces to protect objects in the container and to maintain a presentable appearance following shipping. It is also desirable to reduce the amount of materials used to form the packing container while maintaining design specifications for strength and rigidity.

In an embodiment of a container having one or more symmetrical panels oriented parallel with the x-y plane (discussed below) it has been found, with respect to the symmetrical panel, that a compression reinforcement feature formed by removal or displacement of a small amount of container sidewall material below an upper fold line (or above a lower fold line) on a length-wise side panel of the container can improve stacking strength (also herein referred to as compression strength) of the associated container, while in an embodiment of a container having one or more asymmetrical panels oriented parallel with the x-y plane (also discussed below) it has been found, with respect to the asymmetrical panel, that a compression reinforcement feature formed by extending a small amount of container sidewall material, such as in the form of a tab, above an upper fold line (or below a lower fold line) on a length-wise side panel on an edge proximate a folded over lap joint, can improve stacking strength of the associated container. Such findings are based on substantial experimentation, both design of experiments experimentation and empirical experimentation, involving many parameters, where some of the parameters were found to be statistically significant, while other ones of the parameters were found to be statistically insignificant.

FIG. 1 depicts a container 100, 1100 having a plurality of panels (such as sides, ends, top and bottom panels, for example) integrally arranged with respect to each other and with respect to a set of orthogonal x, y and z axes, where the z-axis defines a direction line in which the container 100 is configured to support a stacking load. Also depicted in FIG. 1 is a graphical cutting plane 90 that illustrates a planar cut through a middle of the container 100, 1100 to form two equally sized halves, a left half 160 and a right half 170. In the case of a container structure having one or more symmetrical panels oriented parallel with the x-y plane (see bottom panel 106 of container 100, for example), such as with some slotted containers (SCs) or a regular slotted container (RSC), the left and right halves 160, 170 of the respective panels oriented parallel with the x-y plane would be mirror images of each other. In the case of container structure having one or more asymmetrical panels oriented parallel with the x-y plane (see top panel 108 of container 100, for example), such as with an overlapped slotted container (OSC), whether it be fully overlapped or partially overlapped with a lap joint, the left and right halves 160, 170 of the respective panels oriented parallel with the x-y plane would not be mirror images of each other, as one half would contain more of the overlapping flap and lap joint than the other half would. As depicted in FIG. 1, the cutting plane 90 cuts through the container 100 lengthwise, such that the overlapped joint that is part of the asymmetrical top panel 108, 108' is disposed on one side of the cutting plane 90, such as in the left half 160, for example. In view of the symmetrical and asymmetrical panels (top and/or bottom) having different structures, it has been found that a compression reinforcement feature suitable for one is not necessarily suitable for another. However, it has also been found that the different compression reinforcement features may be mixed, which will also be discussed further below.

As used herein, reference to side panels and end panels, also referred to in combination as lateral panels, is in reference to those panels oriented orthogonal to the x-y plane (see FIG. 1 for example), and reference to top and bottom panels is in reference to those panels oriented parallel to the x-y plane.

As used herein, the terms orthogonal (perpendicular) and parallel should be interpreted as being substantially orthogonal (perpendicular) and substantially parallel, respectively. For example, the term orthogonal in relation to planar surfaces should be interpreted to include two planar surfaces having an angle therebetween from 85-degrees to 95-degrees, or more typically from 88-degrees to 92-degrees, depending on whether the measurement is taken when the container is in a non-compressed state or a compressed state. And the term parallel in relation to planar surfaces should be interpreted to include two planar surfaces having an angle therebetween from +5-degrees to −5-degrees, or more typically from +2-degrees to −2-degrees, depending on whether the measurement is taken when the container is in a non-compressed state or a compressed state.

As used herein, any reference to a dimension or a percentage value should not be construed to be the exact dimension or percentage value stated, but instead should be understood to mean a dimension or percentage value that is "about" the stated dimension or percentage value, except where it is clear from the description and usage as presented herein.

Figure 2:
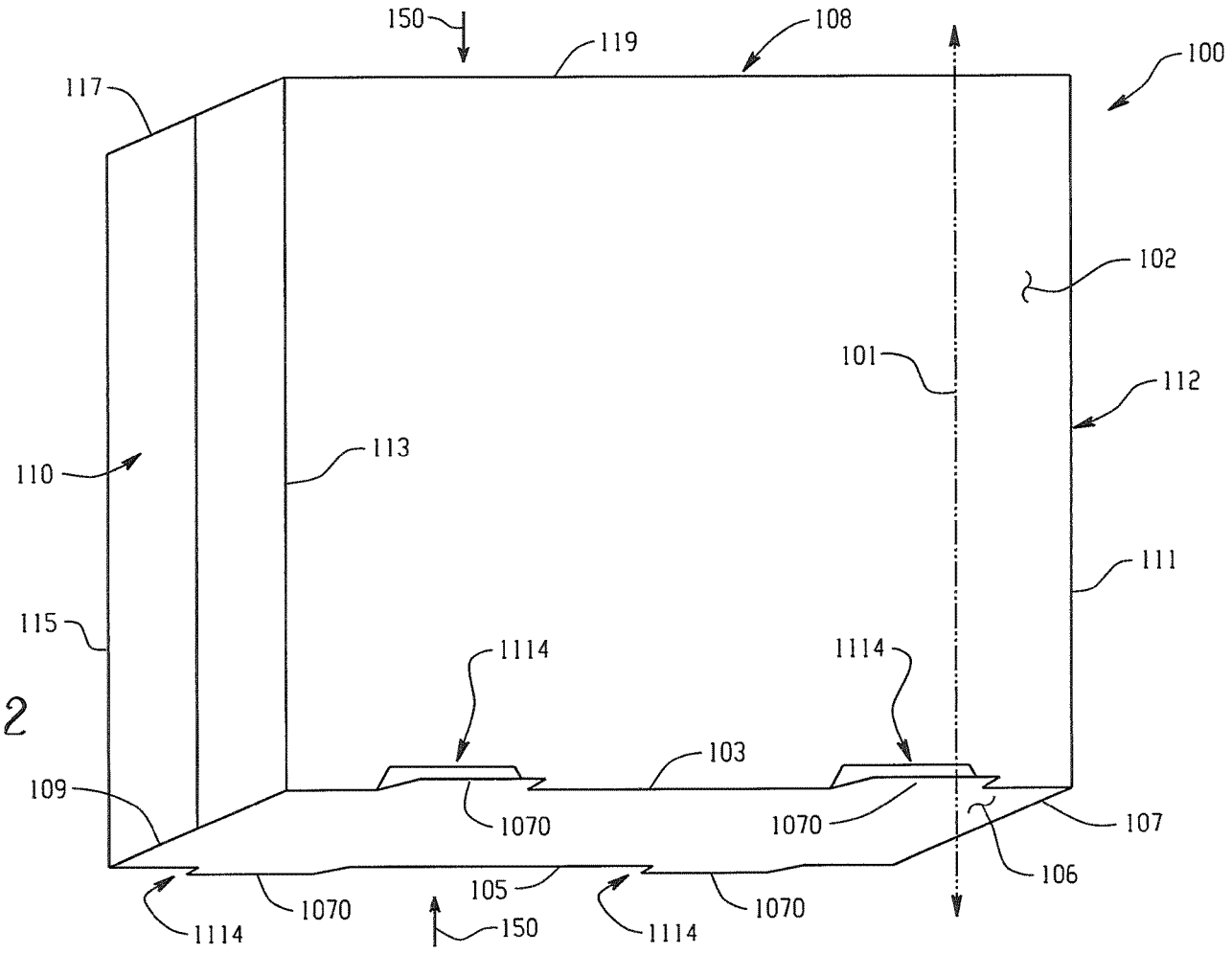
FIG. 2 illustrates a perspective view of an assembled packing container in accordance with an embodiment of the invention.
Figure 3:
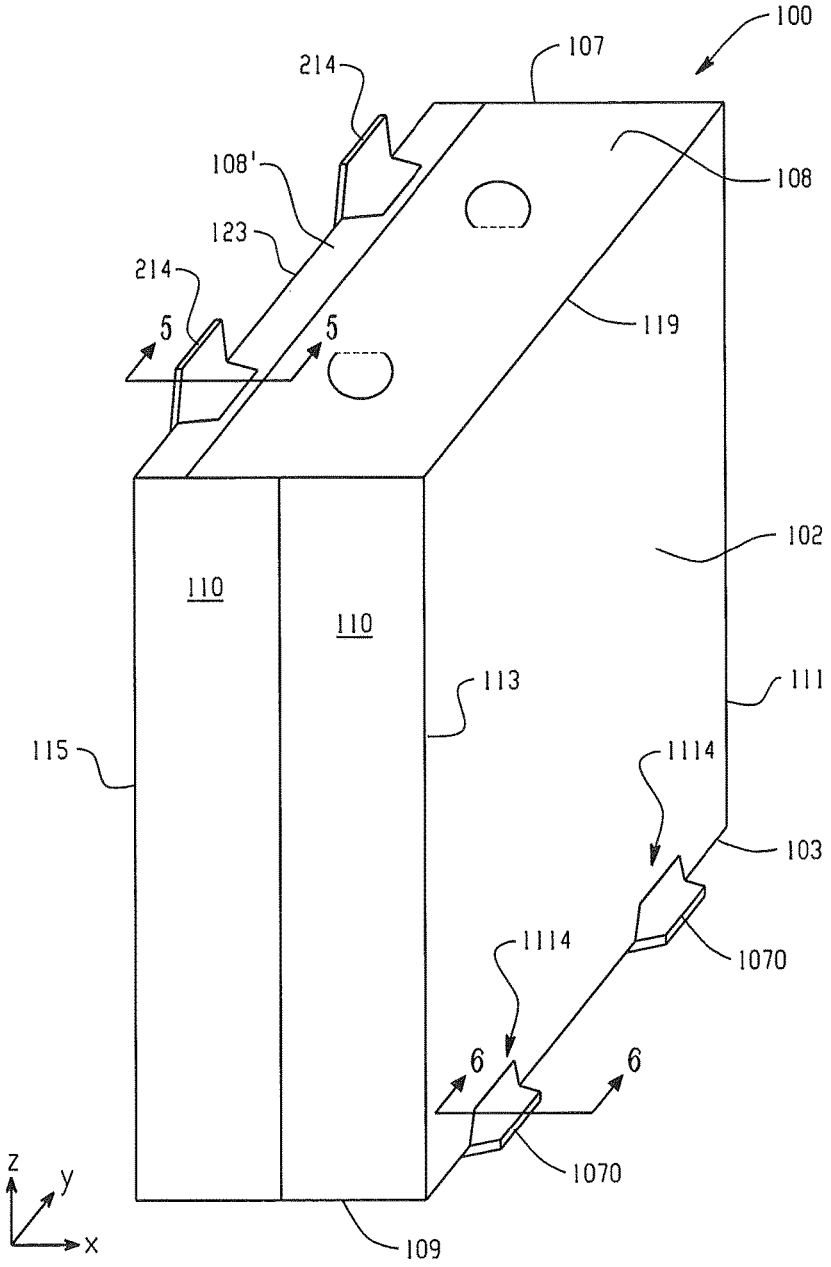
FIG. 3 illustrates another perspective view of the container of FIG. 2.
Figure 4:
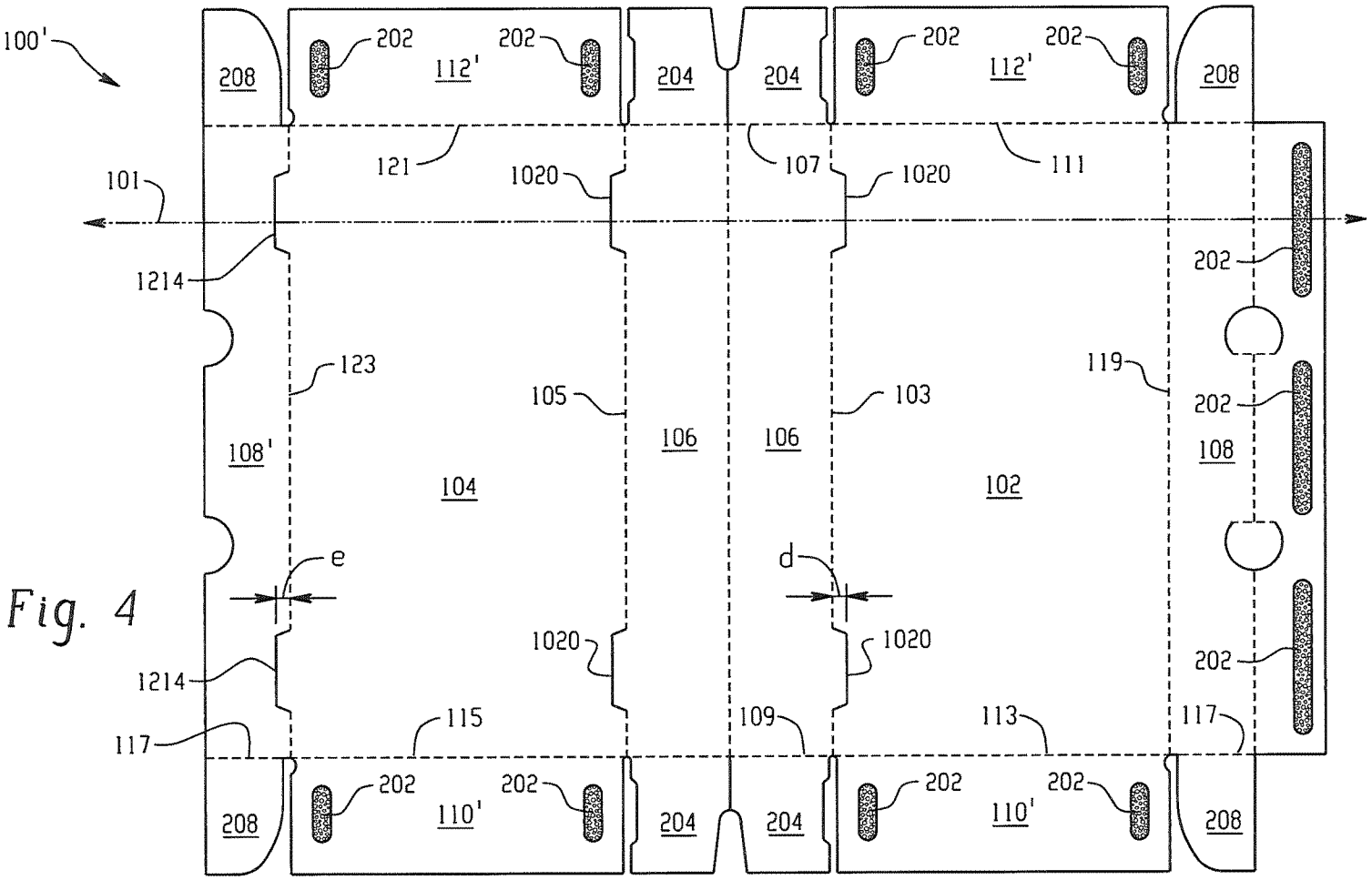
FIG. 4 illustrates a plan view of an unassembled flat blank for the container of FIG. 3.

FIGS. 2 and 3 illustrate different perspective views of an embodiment of an assembled packing container 100. FIG. 4 illustrates a flat blank 100' used to form the container 100. In the flat blank 100', dashed lines represent fold lines and solid lines represent cut lines, except where solid lines enclose hashed lines that represent areas of adhesive. The container 100 includes a first side panel 102 opposing a second side panel 104 (hidden from view in FIG. 2, but shown in FIG. 3); a bottom panel 106 opposing a top panel 108 (hidden from view in FIG. 2, but shown in FIG. 3); and a front panel 110 opposing a rear panel 112 (hidden from view in FIG. 2, but shown in FIG. 3). The intersections of the panels define folded edges 103, 105, 107, 109, 111, 113, 115, 117, 119, 121, and 123 (edges 121 and 123 shown in FIG. 3). In the illustrated embodiment, the side panels 102 and 104 include compression reinforcement features (CRFs) 1114, where each CRF 1114 is formed from a cut line 1020 (see FIG. 4) that serves to create voids or recesses 1050 (see FIG. 6) in the side panels 102, 104, and a tab 1070 (see FIGS. 2 and 3) when the flat blank 100' is folded to form container 100. As illustrated, the tabs 1070 are coplanar continuous extension of the bottom panel 106 and are arranged substantially perpendicular to the side panels 102, 104 in the folded container 100. In an embodiment, the container 100 is formed from a corrugated sheet material having a fluted corrugated sheet disposed between opposing liner boards. In an embodiment, the corrugated sheet is arranged such that the longitudinal axes of the flutes are orientated in parallel with the direction line 101, which in the example embodiment is oriented parallel with the z-axis. Alternate embodiments may include flutes that may be oriented perpendicular with the direction line 101 or at an oblique angle to the direction line 101, or may include sheet material having no flutes.

The number of CRFs 1114, the arrangement of the CRFs 1114, and the dimensions of the CRFs 1114 have been found to improve the compression strength of the container 100 depending on the dimensions of a particular container and the materials used to fabricate the container. Thus, the illustrated embodiments of FIGS. 2-4 are merely examples. Other embodiments may use any combination of CRFs similar to the CRFs 1114 in alternate arrangements, such as for example one or more CRFs arranged on a panel of a container. Including, for example, one or more CRFs arranged adjacent to a bottom panel, one or more CRFs arranged adjacent to a bottom panel along opposing edges of the bottom panel, one or more CRFs adjacent to a top panel, one or more CRFs adjacent to a top panel along opposing edges of the top panel, or any combination of the embodiments discussed above, as long as the CRFs are employed in a manner consistent with the discussion herein regarding symmetrical and asymmetrical panels.

With respect to symmetrical and asymmetrical panels, and with reference to FIGS. 3 and 4, an embodiment of container 100 includes two CRFs 214 in the form of tabs disposed on a same lengthwise edge of the container 100, with each tab of CRF 214 disposed proximate opposing corners (near end panels 110, 112*s*) of the container 100, and with both tabs of CRFs 214 formed from glue flap 108' and disposed coplanar with the side panel 104 of the container 100 that forms a contiguous folded-under glue flap 108' (see FIGS. 4 and 5), has also been found to have an increase in compression strength where the height of the tabs of CRFs 214, relative to an upper surface of glue flap 108', is greater than zero and equal to or less than half the thickness of the panel 104 from which they are formed. Each tab of CRF 214 is formed from a cut line 1214 (see FIG. 4) that serves to create the aforementioned tab when the flat blank 100' is folded to form container 100. In an embodiment, the panel is a C-flute panel and the height of the tabs of CRFs 214 is greater than zero and equal to or less than 3/32 of an inch. While FIG. 3 also depicts CRFs 1114 proximate the bottom panel 106, it has been found that an increase in compression strength can be attributed to CRFs 214 independent of whether CRFs 1114 are present or not. However, when CRFs 1114 are present, further compression strength is gained.

While FIG. 3 depicts CRFs 214 disposed only proximate the top panel 108 where the top panel 108 overlaps the glue flap 108', it will be appreciated that a container may also be constructed in such a manner as to have similar overlapped panels that form the bottom panel, that is, in place of the illustrated bottom panels 106 depicted in FIGS. 3 and 4. As such, it will be appreciated that CRFs 214 may also be disposed proximate a bottom panel formed from such overlapped panels. As such, any reference to a container having CRFs 214 disposed proximate the top panel 108 is also intended to encompass a container having CRFs 214 disposed proximate an overlapped bottom panel.

As mentioned above, FIG. 4 illustrates an embodiment of a flat blank 100' used to form the container 100 and prior to assembly into a three dimensional shaped container. The solid lines that represent cut lines may be cut by, for example, a cutting die, a scoring and slotting tool, or another other type of cutting device. In fabrication, an adhesive is applied to regions 202 such that flaps 204 and 208 are connected to corresponding panels in an overlapped manner. In the illustrated embodiment, the side panels 110 and 112 (of FIGS. 2 and 3) are formed from panels 110' and 112' (of FIG. 4) respectively, and the top panel 108 is formed by panel 108 overlapping a panel 108' (of FIGS. 3 and 4). The illustrated embodiment includes tabs 214 that form tabs extending from the side panel 104 along the edge 123 as discussed above.

Folding the sheet product to form the edges 103 and 105 compresses the corrugated sheet between the opposing liner boards which may, for example, result in buckling, sagging, or shearing when an excessive compressive force is applied in a direction along the lines 150, that is, along a direction line parallel to the z-axis. The CRFs 1114 remain coplanar with the respective side panels 102 and 104, and are not folded or creased when the container 100 is assembled. More particularly, the cut line 1020 forming each CRF 1114 is not deformed when the container 100 is folded. Thus, the corrugated sheet material in the CRFs 1114 remains unfolded and may withstand greater compressive forces than the adjacent folded edges 103 and 105. As such, it will be appreciated that the recesses 1050 form the compression reinforcement features (CRFs) 1114 on the container 100. Similarly, folding the sheet product to form edge 123 also compresses the corrugated sheet. However, CRFs 214 remain coplanar with the side panel 104. Thus, the corrugated sheet material in the CRFs 214 remains unfolded and may likewise withstand greater compressive forces than the adjacent folded edge 123. As such, it will be appreciated that the tabs 214 form the compression reinforcement features (CRFs) 214 on the container 100.

Experimental testing of the container 100, where side panels 102 and 104 are different dimensions, using a box compression test (BCT) has shown an improvement in BCT results up to 11% over similar containers that did not include the tabs 214.

The testing results varied depending on the arrangement and number of tabs. In this regard, a control container having no tabs was found to have a BCT of 384±9 lbs. A first test container having two tabs similar to the tabs 214 depicted in FIG. 3 arranged such that the pair of tabs 214 is arranged on a first side panel 104 (hidden from view in FIG. 3 but parallel to panel 102) adjacent to top panels 108, 108' resulted in a BCT of 426±19 lbs. (a +11% improvement over the control container).

Figure 5:
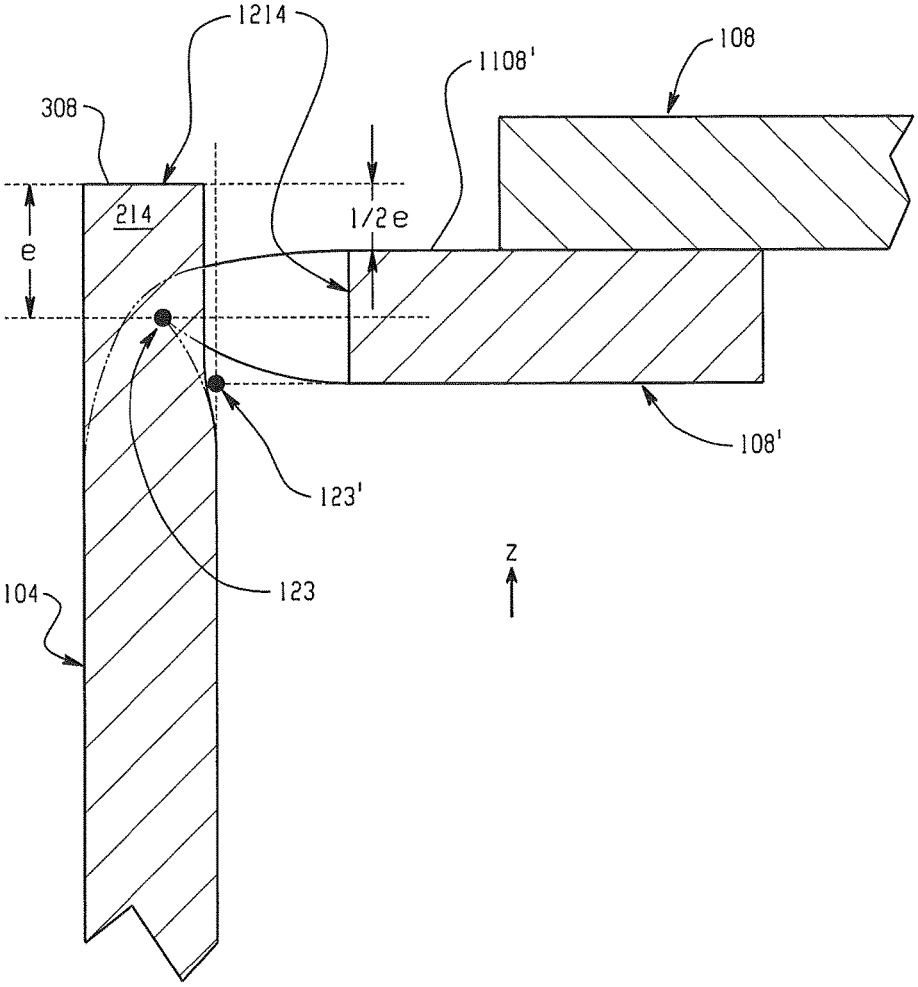
FIG. 5 illustrates in cross section view a portion of the container of FIG. 3 along cut line 5-5.

FIG. 5 illustrates an exaggerated detailed section view through the tab of CRF 214, and through the overlapping region of upper panel 108 overlapping lower panel 108', of FIG. 3. As will be appreciated when folding container material, such as corrugated material for example, a theoretical fold line 123' associated with a container material that would not buckle when folded will in actuality translate slightly inward toward fold line 123 in the folded container 100 as the container material buckles during the folding process. The resulting crease defines the location of the fold line 123 in the flat blank 100' when unfolded, and the location of the fold line 123 in the folded container 100. From the foregoing and with reference to FIG. 5, it will be appreciated that fold line 123 will be the same as fold line 123' before any creases, scores or folds are made to the containerboard used in making the container 100, 1100. As noted above, substantial experimentation, utilizing both design of experiments experimentation and empirical experimentation, has provided a particular arrangement for the height of the tabs of CRFs 214 relative to the fold line 123, or relative to the outer surface 1108' of panel 108', to obtain the advantage of increased compressive strength disclosed herein. As illustrated in FIG. 5, the height of the tab of CRF 214 relative to the translated fold line 123 is represented by dimension "e", and the height of the tab of CRF 214 relative to the outer surface 1108' of panel 108' is represented by dimension "½e" (that is, dimension "½e" measures half the dimension of dimension "e"). In an embodiment, dimension "e" is greater than zero and equal to or less than the thickness (caliper) of panel 104. In an embodiment, dimension "½e" is greater than zero and equal to or less than 3/32 of an inch. As used herein, the dimension "½e" is measured in a condition where the glue flap panel 108' is orthogonal to the side panel 104, and is measured from a planar outer surface of glue flap panel 108'.

With reference to FIGS. 4 and 5, the tabs of CRFs 214 are shown extending from the side panel 104. The cut lines 1214 define the tabs of CRFs 214 such that the tabs are disengaged from a portion of the top panel 108' when the container 100 is folded to form the edge 123 (see FIG. 3). The side panel 104 and the top panel 108' forms a contiguity with the fold line 123 disposed therebetween. The arrangement of the cut lines 1214 and the edge 123 allows the tabs of CRFs 1214 to be formed without deforming the corrugated fluted material that runs continuously between the side panel 104 and the tabs of CRFs 214. The orientation of the longitudinal axes of the flutes of the corrugated fluted material is illustrated by the z-axis. The formed tabs of CRFs 214 include a longitudinal edge having a planar surface 308 defined by the thickness of the corrugated material. In the illustrated embodiment, the planar surface 308 is arranged parallel to the top panel 108' and perpendicular to the outer surface of the side panel 104.

Figure 6:
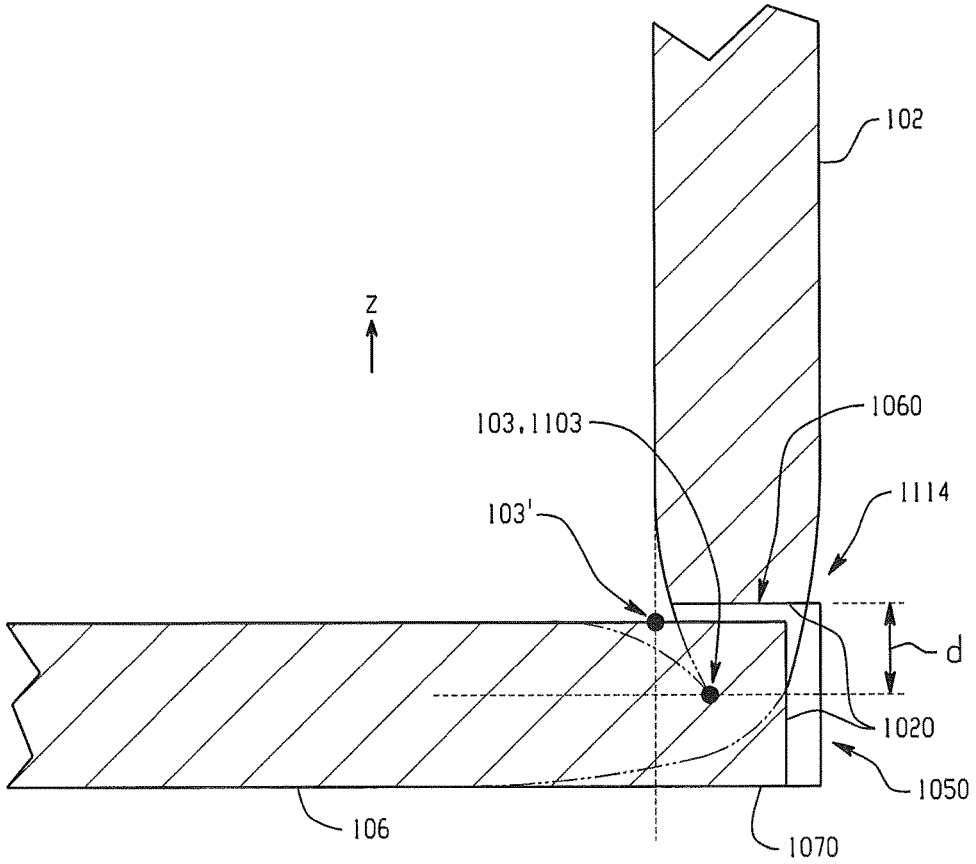
FIG. 6 illustrates in cross section view a portion of the container of FIG. 3 along cut line 6-6.

FIG. 6 illustrates an exaggerated detailed section view through the CRF 1114 of FIG. 3. Similar to the discussion above, it will be further appreciated that when folding the container material, a theoretical fold line 103' associated with a container material that would not buckle when folded will in actuality translate slightly inward toward and to create fold line 103 in the folded container 100 as the container material buckles during the folding process. The resulting crease defines the location of the fold line 103 in the flat blank 100' when unfolded, and the location of the fold line 103 in the folded container 100. From the foregoing and with reference to FIG. 6, it will be appreciated that fold line 103 will be the same as fold line 103' before any creases, scores or folds are made to the containerboard used in making the container 100, 1100. As noted above, substantial experimentation, utilizing both design of experiments experimentation and empirical experimentation, has provided a particular arrangement for the height of the voids or recesses 1050 of CRFs 1114 relative to the fold line 103 to obtain the advantage of increased compressive strength disclosed herein. As illustrated in FIG. 6, the height of the recess 1050 of CRF 1114 relative to the translated fold line 103 is represented by dimension "d". In an embodiment, dimension "d" is greater than zero and equal to or less than one half the thickness (caliper) of panel 102. In an embodiment, dimension "d" is greater than zero and equal to or less than 3⁄32 of an inch.

With reference to FIGS. 4 and 6, CRFs 1114 are shown extending coplanar with the side panel 102, and tabs 1070 are shown extending from the bottom panel 106. The cut lines 1020 define the CRFs 1114 such that the tabs 1070 are disengaged from a portion of the side panel 102 when the container 100 is folded to form the edge 103 (see FIG. 3). The side panel 102 and the bottom panel 106 form a contiguity with the fold line 103 disposed therebetween. The arrangement of the cut lines 1020 and the edge 103 allows the CRFs 1114 to be formed without substantially deforming the corrugated fluted material that runs continuously between the side panel 102 and the CRFs 1114. The orientation of the longitudinal axes of the flutes of the corrugated fluted material is illustrated by the z-axis. The formed CRFs 1114 include a longitudinal edge having a planar surface 1060 defined by the thickness of the corrugated material. In the illustrated embodiment, the planar surface 1060 is arranged parallel to the bottom panel 106 and perpendicular to the outer surface of the side panel 102.

Comparing FIGS. 5 and 6 with FIG. 4 shows dimension "e" associated with CRF 214 formed from cut line 1214, and dimension "d" associated with CRF 1114 formed from cut line 1020.

While embodiments have been described herein having particular characteristic dimensions such as "d", "e", and "½e", for example, it will be appreciated that respective tabs of CRFs 214 need not all be the same height relative to the fold line 123, and that respective recesses 1050 of CRFs 1114 need not be all the same height relative to the fold line 103.

Figure 7:
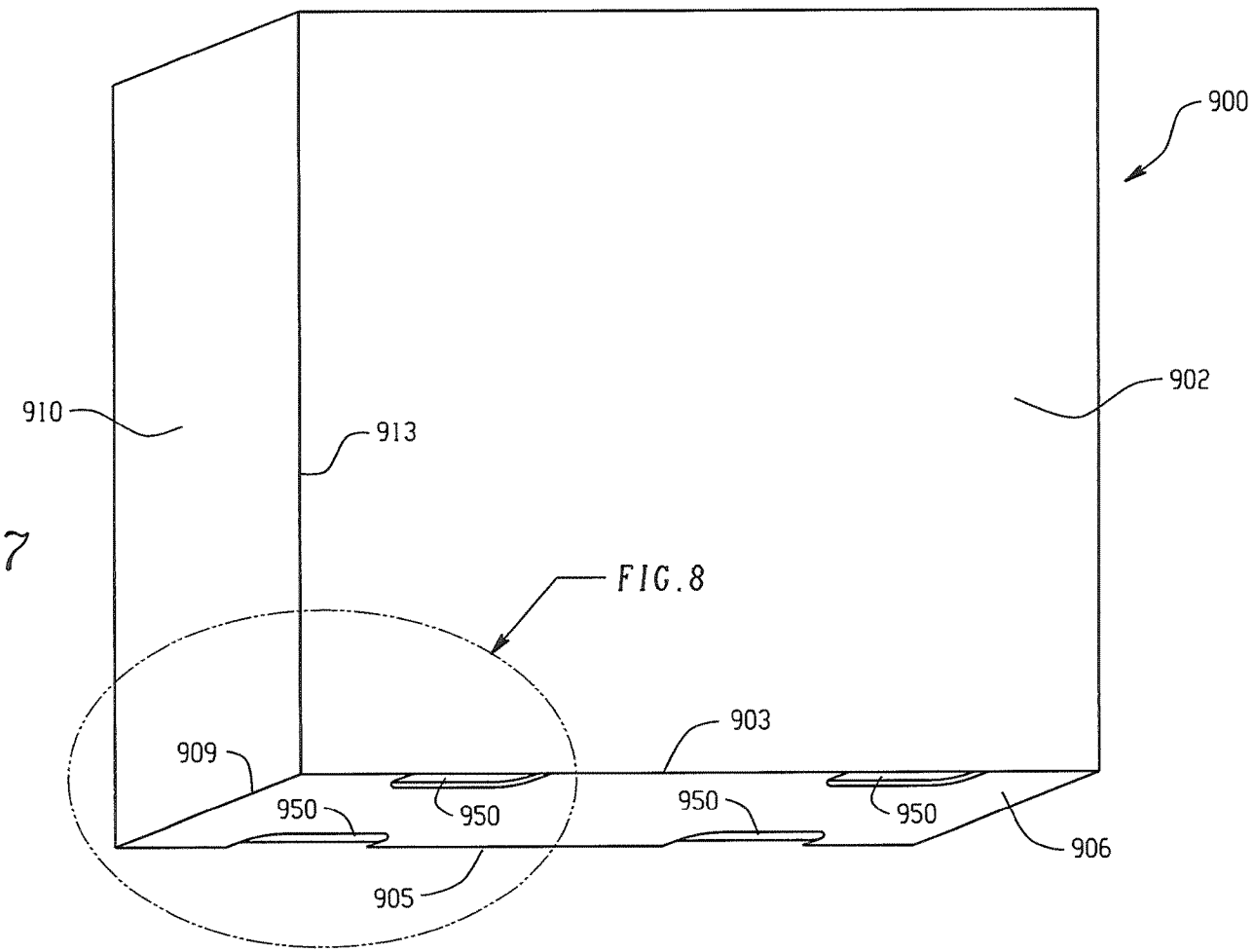
FIG. 7 illustrates a perspective view of an assembled packing carton in accordance with an alternate embodiment of the invention.
Figure 8:
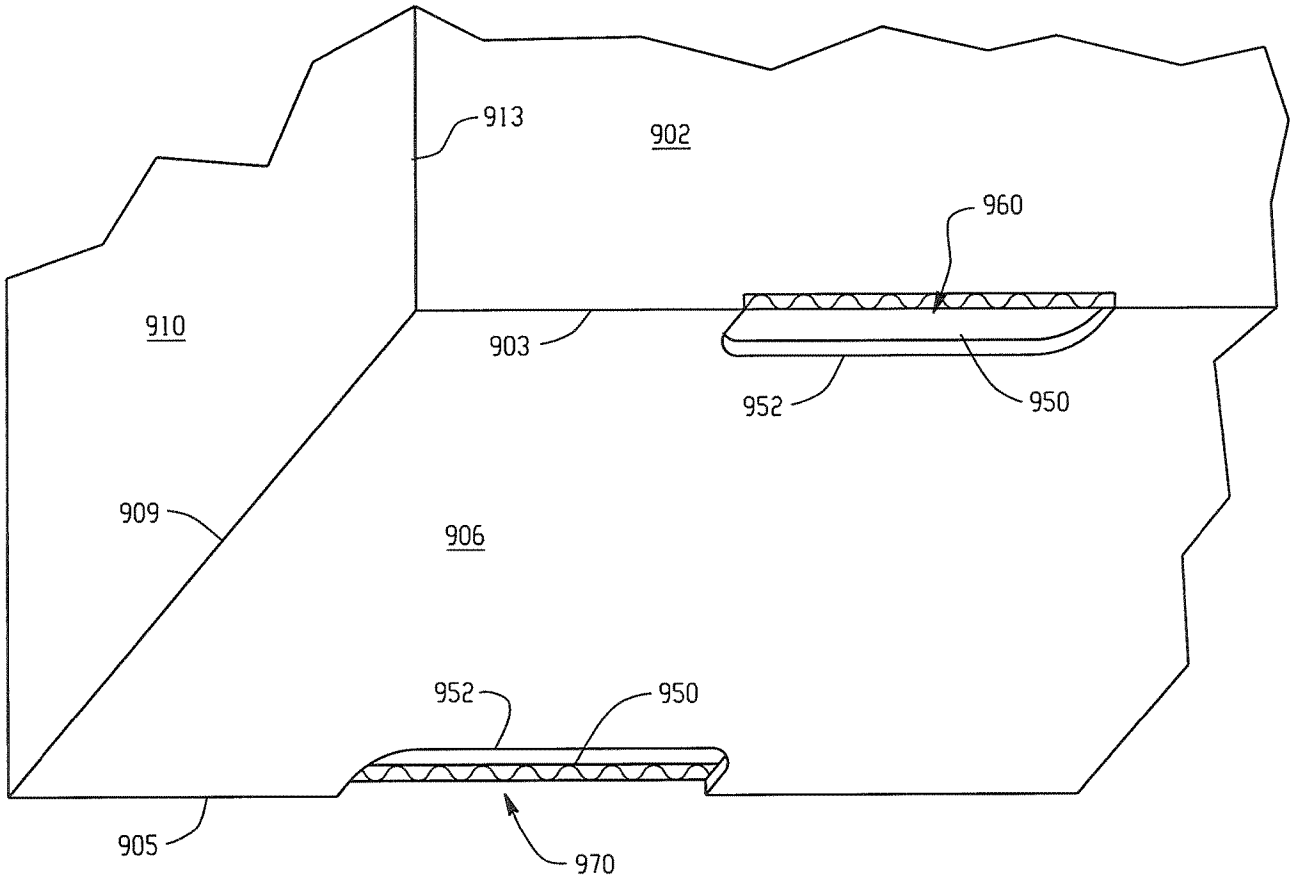
FIG. 8 illustrates a detailed view of the region 8 of FIG. 7.

Referring now to FIG. 7, which illustrates an embodiment of a packing container 900 alternative to that of container 100. The illustrated embodiment includes a side panel 902 and an opposing similar side panel 904 (hidden from view), a bottom panel 906, and a front panel 910. The panels are partially defined by folded edges 903, 905, 909, and 913. The bottom panel 906 is partially defined by cut-out regions 950 that expose edges of the side panels 902 and 904. FIG. 8 illustrates a detailed view of the region 8 (of FIG. 7). Referring to FIG. 8, the cut-out regions 950 are defined by cut lines 952 in the bottom panel 906. In fabrication, the cut line 952 defines a region in the bottom panel 906 that is removed. Removing the defined region and folding the material along the folded edges 903 and 905 exposes an edge 960 of the side panel 902 and an edge 970 of the side panel 904. The exposed edges 960 and 970 also serve to improve the strength of the container 900 as discussed above regarding the CRFs 1114 (of FIG. 2) by providing an unfolded region of the side panels 902 and 904 that increases the compressive strength integrity of the container 900 as compared to a similar container having no cut-out regions 950. In the illustrated embodiment, the planar surface defined by the exposed edges 960 and 970 is arranged in parallel to the planar outer surface of the bottom panel 906. The planar surface of the exposed edges 960 and 970 may be arranged coplanar with the outer surface of the bottom panel 906, or in alternate embodiments, may be recessed such that there is a spatial distance defined by the outer plane of the bottom surface 906 and the respective planes of the exposed edges 960, 970. In an embodiment, the amount of recess is greater than zero and equal to or less than half the thickness of the side panel 902. In an embodiment, the amount of recess is greater than zero and equal to or less than 3⁄32 of an inch. The container 900 may include any number of exposed edges similar to the exposed edges 960 and 970 arranged with any of the panels of the container 900. For example, a top panel of the container 900 may include one or more cut-out regions 950 and exposed edges 960 and 970.

Figure 9:
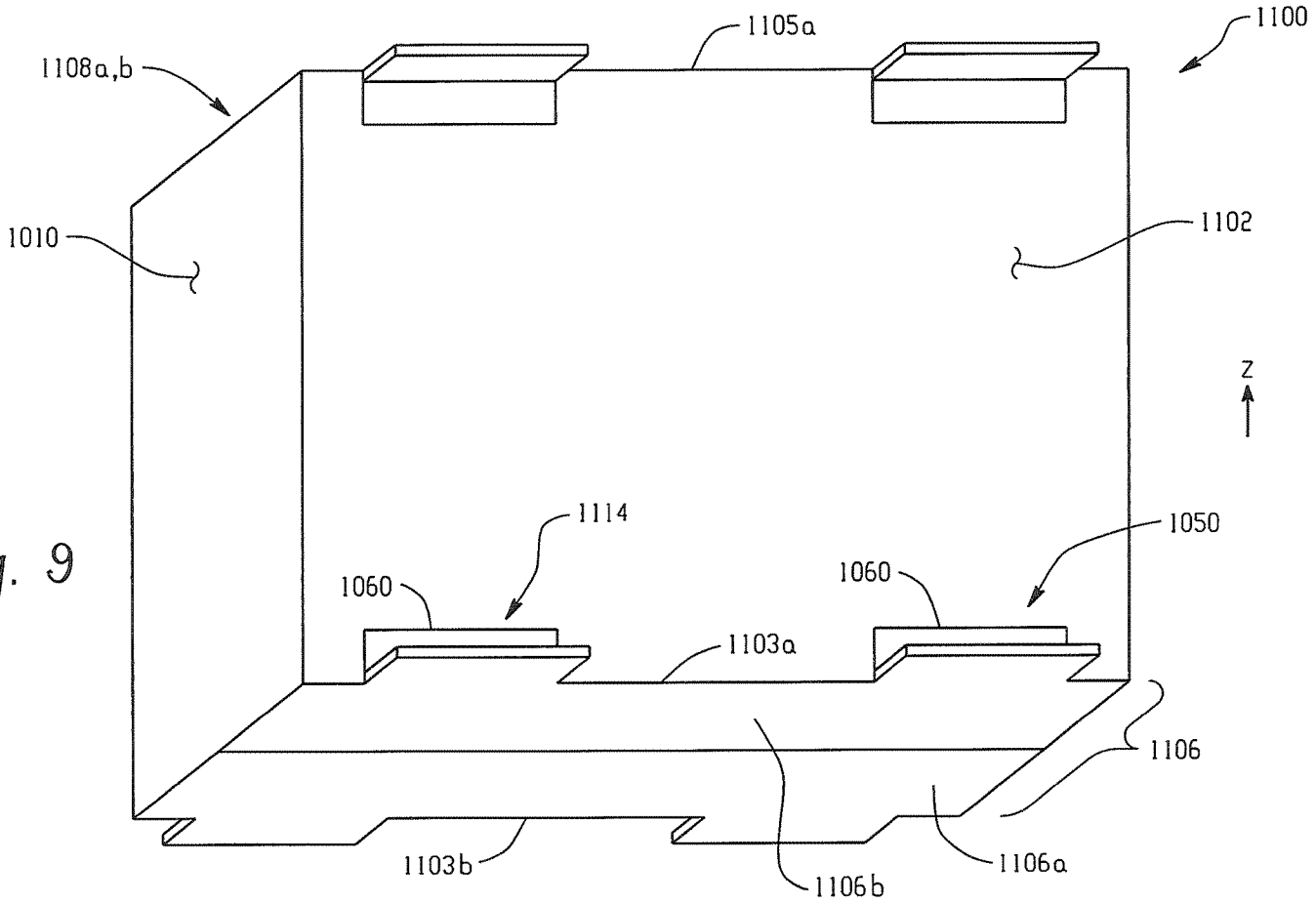
FIG. 9 illustrates a perspective view of an assembled packing container alternative to that of FIG. 3, in accordance with an embodiment of the invention.

With reference now to FIGS. 9, 10 and 11A-C, an embodiment includes a container 1100 having symmetrical top and bottom panels 1108, 1106 (refer to the discussion of FIG. 1 above regarding symmetrical and asymmetrical panels) having CRFs 1114 defined by recesses 1050 similar to that discussed above in connection with FIGS. 2-5 and 6 disposed proximate fold lines 1103, 1105 in the length-wise side panels 1102, 1104 (side panel 1104 hidden from view in FIG. 9). As discussed in connection with FIG. 6, the recesses 1050 have planar edges 1060 formed by a cut line 1020 (see FIGS. 11A-C) through the panel 1102, that are oriented orthogonal to the planar surface of side panel 1102 and perpendicular to the z-axis (see also FIG. 1). With reference back to FIG. 6, the planar edge 1060 is disposed a distance "d" away from the fold line 1103 but at a distance no greater than half a thickness of the panel 1102. As a result, the panel 1102 has a void or recess 1050 between the fold line 1103 and the planar edge 1060. In an embodiment, the distance d creating the recess 1050 equates to 3⁄32 of an inch. As mentioned previously, FIG. 6 includes a z-axis reference to indicate the orientation of the compression reinforcement feature 1114 and planar edge 1060 relative to a compressive load that would be applied to the container 1100 during stacking.

As a side note, when referring to the height of the tabs of CRFs 214 discussed above, reference may be made herein to a positive dimension, such as +3⁄32 of an inch, to indicate the presence of side panel material forming the tab, and when referring to the distance d of recess 1050, reference may be made herein to a negative dimension, such as −3⁄32 of an inch, to indicate the absence of side panel material forming the recess.

Figure 11A:
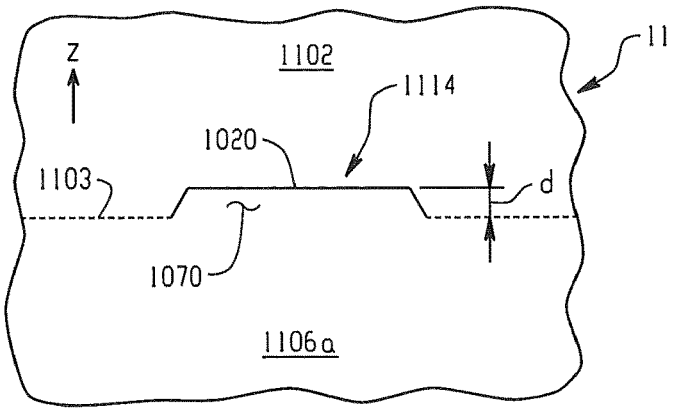
FIGS. 11A, B and C illustrate alternative arrangements to form a compression reinforcement feature in accordance with an embodiment of the invention.

With reference to FIG. 11A, the cut line 1020 can be seen extending into the side panel 1102 a distance "d" from the fold line 1103, which forms a tab 1070 made from material in the side panel 1102. By referring to FIG. 6, it is noteworthy that the tab 1070 extends in a direction orthogonal to the z-axis when the panels 1102, **1106*a* of container 1100 are folded, which is in a different direction as compared to the tabs of CRFs 214 discussed above. In an embodiment, the ends of cut line 1020 terminate at the fold line 1103**.

Figure 11B:
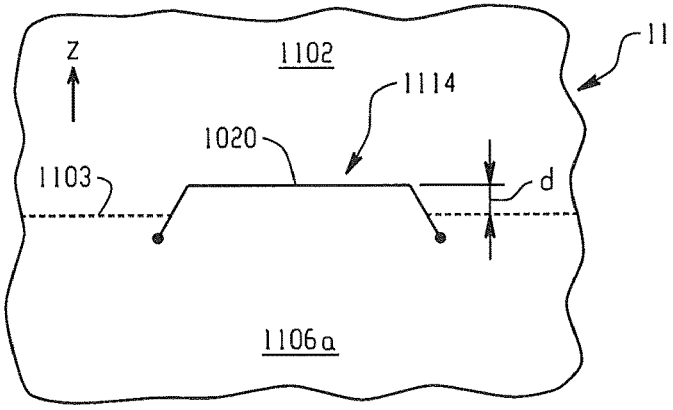

In another embodiment, and with reference to FIG. 11B, the ends of cut line 1020 terminate on the bottom panel **1106*a*. That is, the compression reinforcement feature 1114 is formed by a cut line 1020 that begins at a first point on the bottom panel 1106*a*, traverses a first distance along a first line that extends across the fold line 1103, traverses a second distance along a second line that runs substantially parallel to the fold line 1103, and traverses a third distance along a third line that extends back across the fold line 1103 to end at a second point on the bottom panel 1106*a*, wherein the second line defines a location of the planar edge 1060 of the compression reinforcement feature 1114. As with the embodiment of FIG. 11A, the cut line 1020 can be seen extending into the side panel 1102 a distance "d" from the fold line 1103, which in an embodiment is no greater than half the thickness of the side panel 1102**.

Figure 11C:
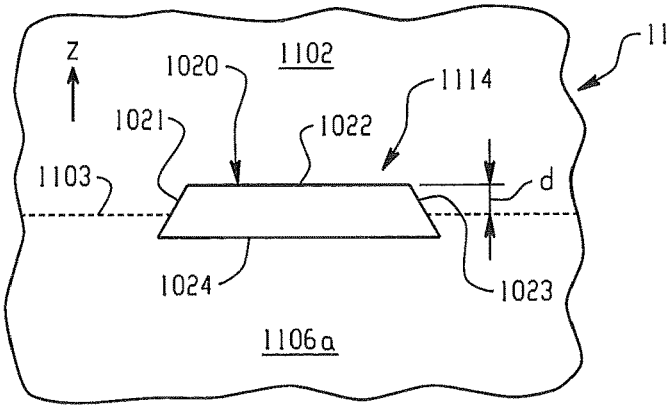

In another embodiment, and with reference to FIG. 11C, the compression reinforcement feature 1114 is formed by a cut line 1020 that begins at a first point on the bottom panel 1106*a*, traverses a first distance along a first cut line 1021 that extends across the fold line 1103, traverses a second distance along a second cut line 1022 that runs substantially parallel to the fold line 1103, traverses a third distance along a third cut line 1023 that extends back across the fold line 1103, and traverses a fourth distance along a fourth cut line 1024 that ends at the first point on the bottom panel 1106*a*, wherein the first, second, third and fourth cut lines define a closed perimeter of a cutout, and wherein the second cut line 1022 defines a location of the planar edge 1060 (see FIGS. 6 and 9) of the compression reinforcement feature 1114. As with the embodiment of FIGS. 11A and 11B, the cut line 1020 can be seen extending into the side panel 1102 a distance "d" from the fold line 1103, which in an embodiment is no greater than half the thickness of the side panel 1102. The fourth cut line 1024 may be straight, curved, or formed from a plurality of connected cut lines.

While FIGS. 11A-C each depict a cut line 1020 illustrated with a defined number of lines, such as three lines in FIGS. 11A and B, and four lines in FIG. 11C, it will be appreciated that each of the cut lines 1020 may include more than the number of illustrated lines as long as the resulting cut line serves a purpose disclosed herein.

Figure 10:
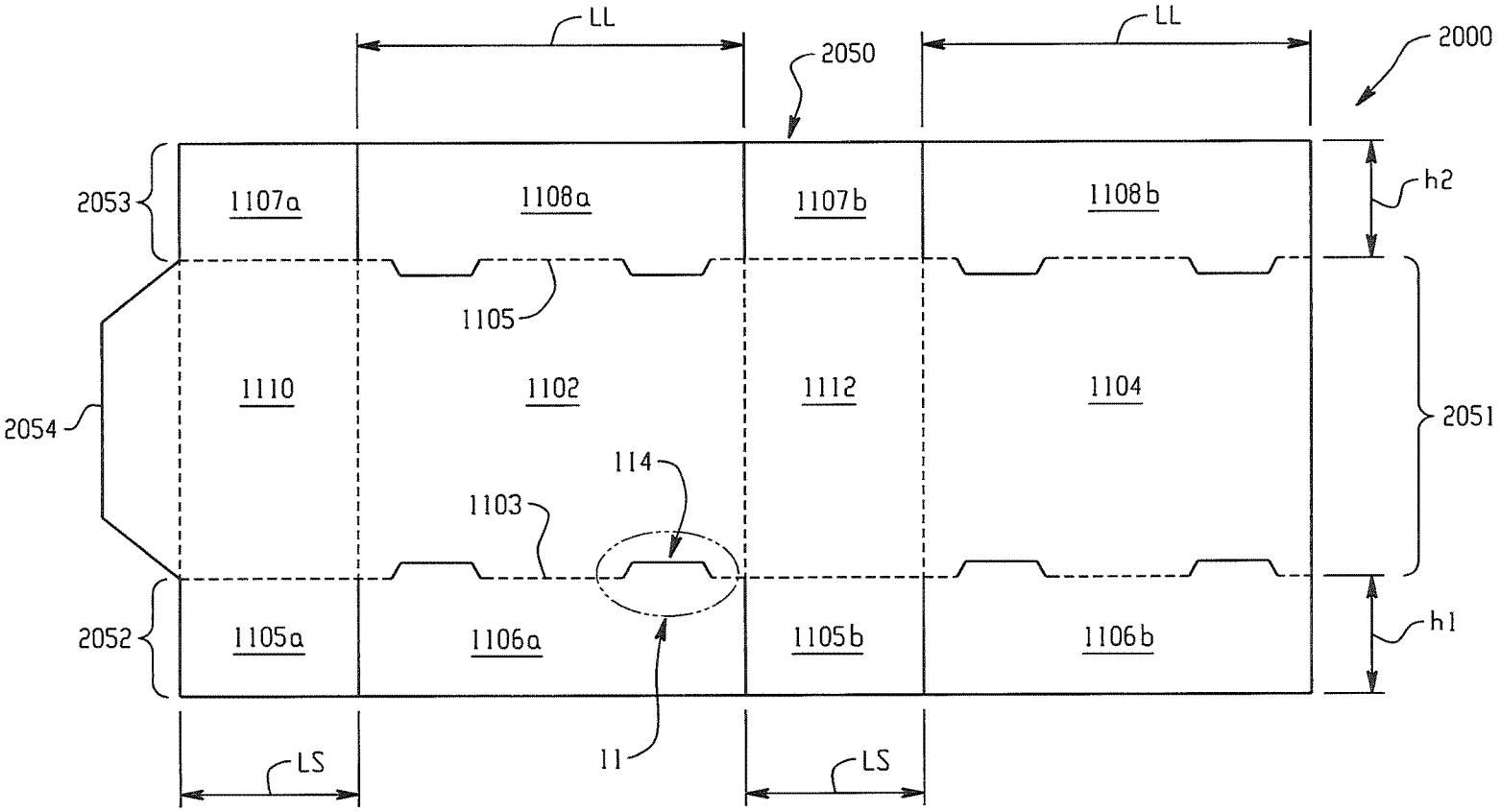
FIG. 10 illustrates a flat blank for the container of FIG. 9, in accordance with an embodiment of the invention.

Referring to FIG. 10, an embodiment of the container 1100 is formed from a flat blank 2000 having a plurality of panels 2050 that fold to form a regular slotted container (RSC) 1100 having four lateral panels (that is, four side panels). While embodiments described herein refer to containers having four lateral panels, it will be appreciated that the scope of the invention is not limited to containers having only four lateral panels, but also encompasses containers having another number of lateral panels, such as three, four, five, six, seven, eight, nine or ten lateral panels, for example. As illustrated in FIG. 10, CRFs 1114 may be arranged on either or both fold lines 1103, 1105 of the flat blank 2000, and may be in any quantity that serves a purpose disclosed herein.

With reference to FIGS. 9-10 in addition to FIG. 1, the plurality of panels 2050 includes a first panel 1102 having a first planar surface, and a second panel 1108*a* having a second planar surface, wherein the first panel 1102 and the second panel 1108*a* form a contiguity with a fold line 1105 disposed therebetween. In a folded state, the first planar surface of the first panel 1102 is disposed parallel to the x-z plane or the y-z plane (refer to FIG. 1 for illustration of x, y, z axes), and the second planar surface of the second panel 1108*a* is folded about fold line 1119 and disposed orthogonal to the first panel 1102.

In the embodiment of FIG. 10, the plurality of panels 2050 are so arranged as to form a regular slotted container (RSC) 1100 when folded. For example, the plurality of panels 2050 are arranged to form a plurality of central panels 2051, a plurality of first outboard panels 2052, a plurality of second outboard panels 2053, and at least one end panel 2054. The plurality of central panels 2051 defines major central panels 1102, 1104, and minor central panels 1110, 1112. The plurality of first and second outboard panels 2052, 2053, respectively define major outboard panels 1106*a,b* and 1108*a,b* that oppose each other, and minor outboard panels 1105*a,b* and 1107*a,b* that oppose each other. As depicted, each of the plurality of first and second outboard panels 2052, 2053 is disposed with respect to one of the plurality of central panels 2051 with a fold line 1103, 1105 disposed therebetween. Each of the plurality of first and second outboard panels 2052, 2053 have respective perpendicular dimensions "h1" and "h2" from the respective fold line 1103, 1105 to an outer edge of the respective outboard panel 2052, 2053, where "h1" may be equal to, greater than, or less than "h2". In an embodiment, the opposing major outboard panels 1106*a*, 1108*a* and 1106*b*, 1108*b* meet in a middle of the RSC 1100 when folded (see FIG. 9), and the opposing minor outboard panels 1105*a*, 1107*a* and 1105*b*, 1107*b* do not meet in the middle of the RSC 1100 when folded. In an embodiment, each of the major outboard panels 1106*a,b* and 1108*a,b* have a length "LL" that is longer than a length "LS" of each of the minor outboard panels 1105*a,b* and 1107*a,b*. While FIG. 10 depicts a plurality of panels 2050 that are foldable to form a non-square RSC 1100 having a length "LL" and a width "LS", where "LL" is greater than "LS", it will be appreciated that the scope of the invention is not so limited, and also encompasses a container 1100 having a length "LL" that equals its width "LS", such as in a square container 1100. It will also be appreciated that the heights "h1" and "h2" of the outboard panels 2052, 2053 may be sized such that some or none of the outboard panels 2052, 2053 meet in the middle of the RSC 1100 when folded.

As discussed above, CRFs 214, 1114 may be located on upper and/or lower edges (relative to the z-axis depicted in FIG. 1) of container 100, 1100, may be more advantageously located on edges of major central panels 1102, 1104, and may be in any quantity suitable for a purpose disclosed herein. In an embodiment, and with reference to container 100 depicted in FIG. 3, two CRFs 214 are disposed on the upper edge 123 proximate opposing ends of the container 100, and a pair of CRFs 1114 are each disposed on respective lower edges 103, 105, however, in another embodiment CRFs 1114 may be omitted. In an embodiment, and with reference to container 1100 depicted in FIG. 9, a pair of CRFs 1114 are each disposed on respective lower edges 1103*a,b*, and a pair of CRFs 1114 are each disposed on respective upper edges 1105*a,b*, however, in another embodiment the upper or lower four CRFs 1114 may be omitted.

Figure 12:
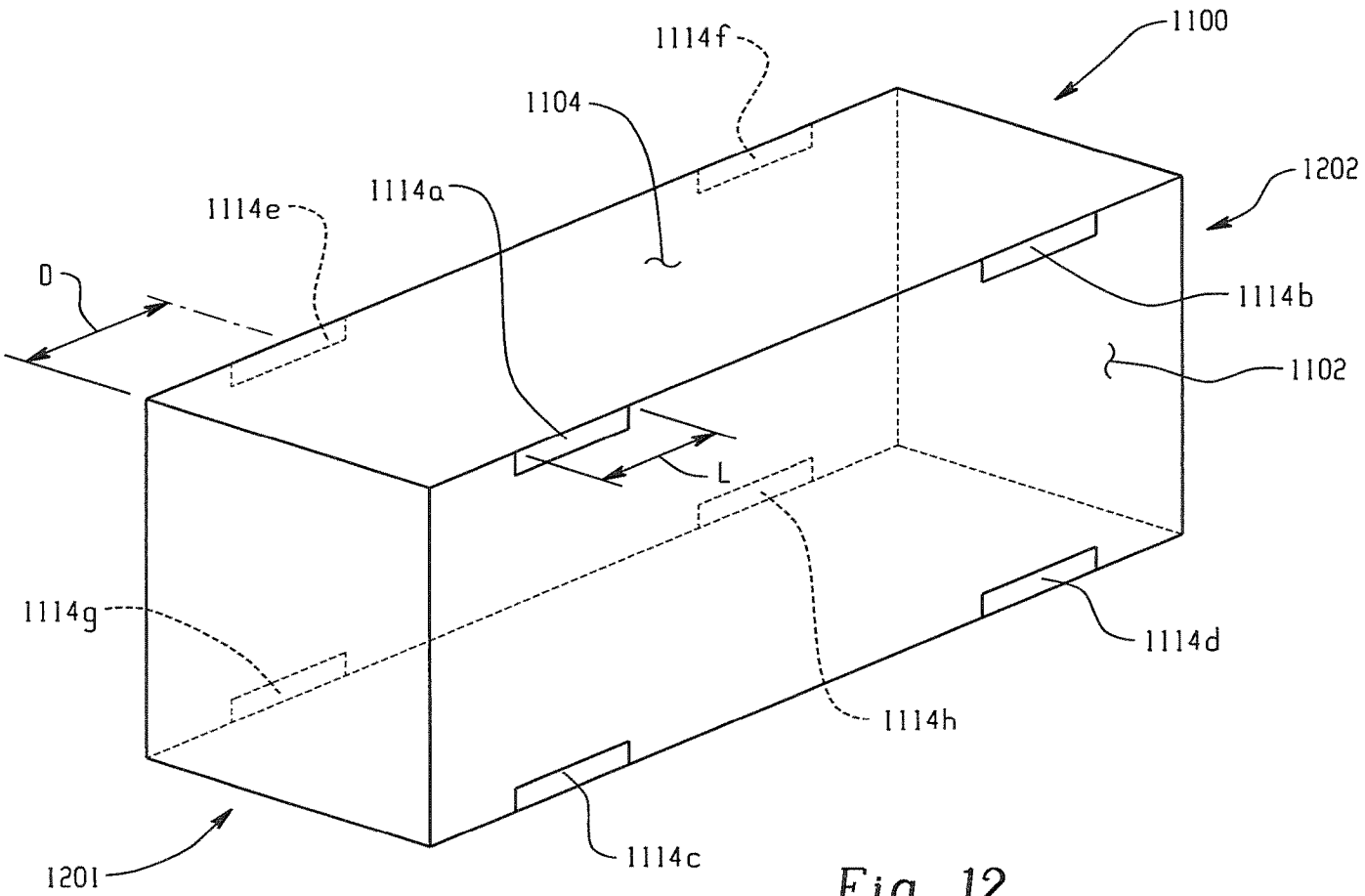
FIG. 12 illustrates a perspective view of a container having a plurality of compression reinforcement features, in accordance with an embodiment of the invention.

In an embodiment, and with reference to FIG. 12, side panels 1102 and/or 1104 include compression reinforcement features 1114 *a, b, c, d, e, f, g*, and *h*. While FIG. 12 illustrates side panel 1102 having compression reinforcement features 1114 *a, b, c, d*, and side panel 1104 having compression reinforcement features 1114 *e, f, g, h*, it will be appreciated that the scope of the invention is not so limited and also encompasses other quantities, more or less, of compression reinforcement features 1114 disposed in a manner consistent with a purpose disclosed herein.

In an embodiment, compression reinforcement features 1114 *a, b, c, d, e, f, g*, and *h*, are arranged in pairs along respective edges of container 1100 as illustrated in FIG. 12, with a first compression reinforcement feature of the pair, 1114*a* for example, being disposed proximate a first end 1201 of the side panel 1102 of container 1100, and a second compression reinforcement feature of the pair, 1114*b* for example, being disposed proximate a second end 1202 of the side panel 1102 of the container 1100. In an embodiment, a centerline of the first compression reinforcement feature 1114*a* is disposed at a distance from the first end 1201 of the first panel 1102 that is equal to or less than 40% of a length "LL" of the first panel 1102 (see FIG. 10 for length "LL"). In another embodiment, a centerline of the second compression reinforcement feature 1114*b* is disposed at a distance from the second end 1202 of the first panel 1102 that is equal to or less than 40% of the length "LL" of the first panel 1102. In an embodiment, a centerline of the first compression reinforcement feature 1114*a* is disposed at a distance from the first end 1201 of the first panel 1102 that is equal to or less than 25% of a length "LL" of the first panel 1102. In an embodiment, a centerline of the second compression reinforcement feature 1114*b* is disposed at a distance from the second end 1202 of the first panel 1102 that is equal to or less than 25% of the length "LL" of the first panel 1102. In an embodiment, the compression reinforcement feature 1114*a* and the compression reinforcement feature 1114*c* are disposed equidistant from a same end 1201 of the first panel 1102. In an embodiment, any one of compression reinforcement features 1114*a, b, c, d, e, f, g, h*, has a length "L" that is from 10% to 30% of a length "LL" of the first panel 1102. In an embodiment, any one of compression reinforcement features 1114*a, b, c, d, e, f, g, h*, has a length "L" that is from 10% to 20% of a length "LL" of the first panel 1102. In an embodiment, the plurality of panels of container 100, 1100 form a box having four lateral sides, which in an embodiment has a length dimension (in a direction parallel to the y-axis) from 14 inches to 33 inches, has a width dimension (in a direction parallel to the x-axis) from 8 inches to 14 inches, and has a height dimension (in a direction parallel to the z-axis) from 6 inches to 16 inches.

While reference is made herein to a container 100, 1100 having certain overall dimensions, it will be appreciated that such noted dimensions are merely to establish an order of magnitude and not to be construed as being exact. For example, a container formed in accordance with an embodiment of the invention may fall anywhere within the dimensional window having a minimum envelope size defined by a 5-inch cube, and a maximum envelope size defined by a 50-inch cube, where the container may or may not be a cube.

In view of the foregoing, it will be appreciated that an embodiment of the invention includes a container 100, 1100 having a plurality of panels that includes a first side panel, a second side panel, a first end panel, and second end panel, a top panel and a bottom panel, the plurality of panels being integrally arranged with respect to each other to form a box having four lateral sides and configured to support a stacking load when exerted in a z-direction from the top panel toward the bottom panel. Wherein the first side panel and a first portion of the top panel form a contiguity with a first fold line disposed therebetween. Wherein the second side panel and a second portion of the top panel form a contiguity with a second fold line disposed therebetween. Wherein a first compression reinforcement feature is disposed proximate the first fold line and proximate the first end panel. Wherein a second compression reinforcement feature disposed proximate the first fold line and proximate the second end panel. Wherein a third compression reinforcement feature disposed proximate the second fold line and proximate the first end panel. Wherein a fourth compression reinforcement feature disposed proximate the second fold line and proximate the second end panel. Wherein each of the first and second compression reinforcement features have a planar edge oriented orthogonal to the first side panel and perpendicular to the z-direction, each respective planar edge being disposed a distance away from the first fold line but at a distance no greater than half a thickness of the first panel, the first panel having a void between the first fold line and each respective planar edge. Wherein each of the third and fourth compression reinforcement features have a planar edge oriented orthogonal to the second side panel and perpendicular to the z-direction, each respective planar edge being disposed a distance away from the second fold line but at a distance no greater than half a thickness of the second panel, the second panel having a void between the second fold line and each respective planar edge.

Through substantial experimentation, discussed further below, it has be found that CRF's 214 (tabs) are advantageous on such a container as depicted in FIGS. 3, 4 and 5, that is, a container 100 having an overlapped top panel 108, and that CRFs 1114 (recesses) are advantageous on such a container as depicted in FIGS. 6, 9 and 10, that is, a container 1100 having non-overlapping top and/or bottom panels 1108*a,b* and 1106*a,b*, respectively.

It will be appreciated that a compression strength of a container could be dependent upon many variables associated with the container, such as a length, a width, a height of the container, the material forming the container, the type of fluting of fluted material forming the container, and the thickness of material forming the container, for example. Also, and in the case of the container having one or more of the aforementioned compression reinforcement features, the compression strength of the container could be dependent upon a length of the compression reinforcement feature, placement of the compression reinforcement feature, a height dimension (plus or minus) of the compression reinforcement feature, and a quantity of the compression reinforcement features. Through the use of exhaustive design of experiment (DOE) modeling, the following has been found.

With reference now to FIG. 16, Table-1 provides DOE box compression test (BCT) scaled estimates for a container made from lightweight fluted containerboard having B-flute and a minimum edgewise compression test specification of 32 lbs/inch. Column-1 labeled "Term" provides a listing of 23 parameters used in this DOE, plus the first entry labeled "Intercept", which is the value in pounds from which all other parameters are scaled (plus or minus). Column-2 labeled "Scaled Estimates" is the value in pounds resulting from the DOE. Column-3 provides a graphical representation of the content of Column-2. Column-4 labeled "Prob>|t|" indicates the probability that a particular parameter is statistically significant or not with respect to the DOE results.

With reference now to FIG. 17, Table-2 provides DOE BCT scaled estimates similar to those of Table-1, but for a container made from heavyweight fluted containerboard having C-flute and a minimum edgewise compression test specification of 44 lbs/inch.

With reference now to FIG. 18, Table-3 provides DOE BCT scaled estimates similar to those of Tables-1 and 2, except that it combines the data from Tables-1 and 2, hence the additional entries of "Board Combination [44C]" and "Board Combination [32B]" in Column-1.

Referring to Table-1 as an example, a container 1100 having a CRF 1114 as discussed above disposed on a length-wise edge 1103 of the container 1100 (see Column-1 parameter labeled "Tab Height-Length Panel [−½ caliper]"), has a DOE BCT result that is +29.397971 pounds stronger than the normalized intercept value. However, it is not only the scaled estimates that are of interest, but also the probability of statistical significance that is presented in Column-4, which in this example has a value of 0.0015. For DOE's it is accepted practice that if a level of significance for an estimated parameter is equal to or greater than 95% probability, then the results of that parameter is considered to be statistically significant. With respect to Column-4, equal to or greater than 95% probability equates to a "Prob>|t|" value of equal to or less than 0.05. As such, the subject CRF 1114 with a ½ caliper recess has a probability of being statistically significant in improving the compression strength of the container 1100.

By referring to Tables-1, 2 and 3 in combination, several parameters show up as being statistically significant in improving the compression strength of a container. However, for a given container size one of the aforementioned parameters consistently shows up as being statistically significant, which is the parameter in each Column-1 labeled "Tab Height-Length Panel [−½ caliper]". This parameter correlates with the CRF 1114 discussed above in connection with FIGS. 6, 9 and 10, where the "[−½ caliper]" relates to the dimension of a recess having a "d" dimension of 3/32 of an inch.

It is noteworthy, however, to also consider parameters that appear to have statistical significance in one or more, but not all, of Tables-1, 2 and 3. For example, the parameter labeled "Corner Space [At corner]" has equal to or greater than 95% probability of being advantageously statistically significant in Tables-1 and 3, and the parameter labeled "Tab Length [20%]" has equal to or greater than 95% probability of being advantageously statistically significant in Table-3.

The parameter labeled "Corner Space [At corner]" refers to a CRF 214, 1114 that is located closer to a corner of the container than to a center region of the container, and the parameter labeled "Tab Length [20%]" refers to a CRF 214, 1114 having a length that is 20% of the length of the edge of the container on which it is located, both of which will now be discussed further with reference back to FIG. 12.

With reference to FIG. 12, a RSC 1100 having length, width and height dimensions of 15 inches×8 inches×6.25 inches, respectively, underwent box compression tests with CRFs 1114*a, b, c, d, e, f, g, h* having varied lengths and having varied locations along an edge of the container.

A first set of test results showed that the RSC 1100 had improved compression strength when the centers of the CRFs were placed a distance of 3.5 inches from the end of the container, versus being placed substantially at the end of the container, and versus being placed 5.5 inches from the end of the container. However, all three placements showed an improvement in compression strength over a baseline RSC 1100 having no CRFs at all, the most advantageous placement (centerline at 3.5 inches from container end) had an improvement of 11%.

A second set of test results showed that the RSC 1100 had improved compression strength when the length of the CRFs were 20-30% of the edge length of the RSC (on a lengthwise side of the RSC), versus being 10% or 40%. However, all four lengths showed an improvement in compression strength over a baseline RSC 1100 having no CRFs at all. While the most advantageous length was 30%, having an improvement over the baseline RSC of 12.5%, an 11.2% improvement was found for a 20% length, a 4.4% improvement for a 10% length, and a 3.6% improvement for a 40% length.

From all of the foregoing substantive DOE's and empirical tests, it was found that two types of CRFs 214 (tabs) and 1114 (recesses) can be advantageous in improving the compressive strength of a respective container 100 and 1100, when strategically used and placed as disclosed herein.

For a container 100, such as an overlapped container as depicted in FIGS. 3, 4 and 5, CRFs 214 having a tab height, relative to the outer surface of panel 1108', of half a thickness of the side panel 104 forming the container 100 have been found to be advantageous, while for a container 1100, such as a slotted container or a regular slotted container as depicted in FIGS. 6, 9 and 10, CRFs 1114 having a recess dimension "d" of half a thickness of the side panel forming the container has been found to be advantageous. For a container formed from containerboard having a C-flute, the half-thickness dimension equates to about 3/32 of an inch.

For either the container 100 or the container 1100, respective CRFs 214, 1114 having a length of 10-30% of the length of the container have been found to be advantageous, and respective CRFs 214, 1114 having a respective centerline located at a distance from the end of the container that is between 25-40% of the length of the container have been found to be advantageous.

For the container 100, placing CRFs 214 only on one edge, the edge proximate the glued overlap as depicted in FIG. 3, has been found to be advantageous, while for the container 1100, placing CRFs 1114 on any opposing edges, as depicted in FIG. 9, has been found to be advantageous. While not being held to any particular theory, it is contemplated that the difference between single-edge reinforcement, such as using a CRF 214 in the form of a "tab", versus two-edge reinforcement, such as using a CRF 1114 in the form of a "recess", is a result of improving uniform stress distribution across the surfaces of the respective container during compressive loading.

Figure 13:
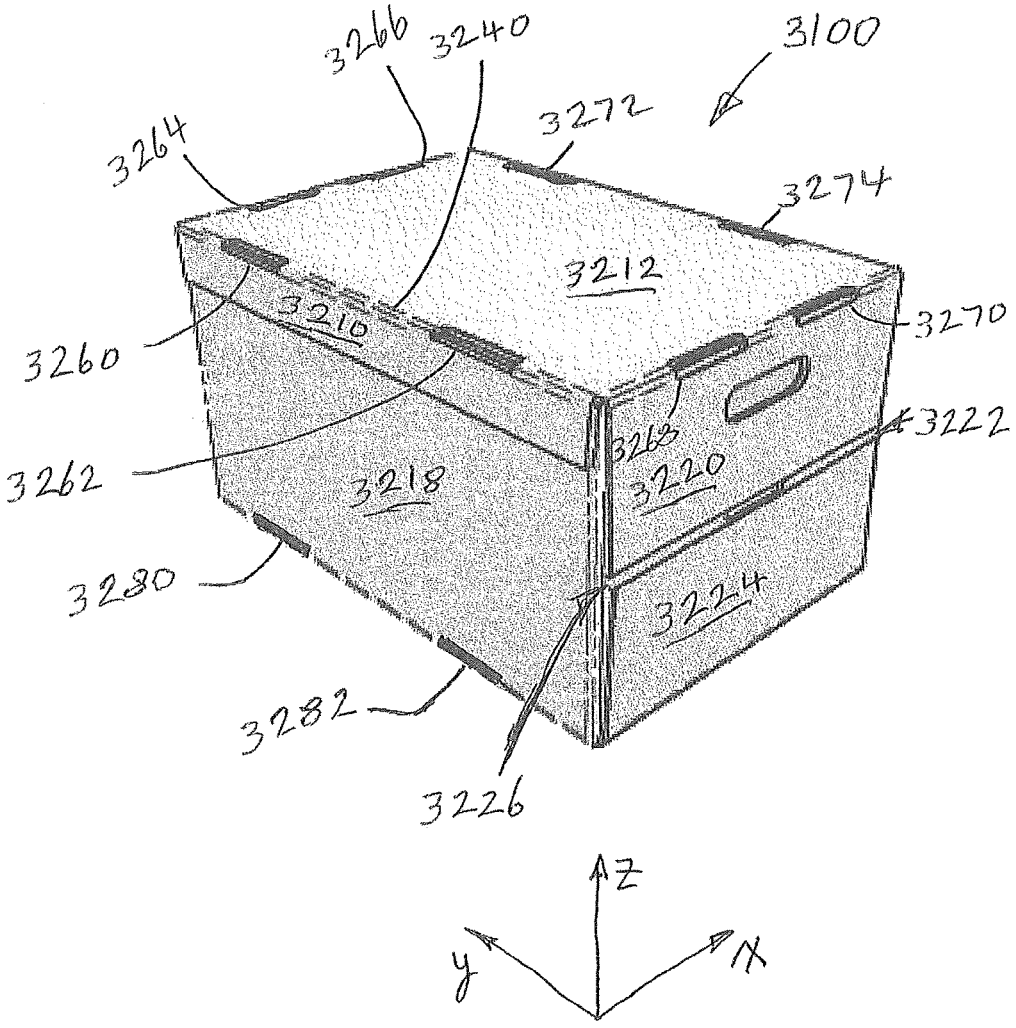
FIG. 13 depicts a perspective view of a container relative to an orthogonal set of x-y-z axes alternative to the container of FIG. 1, in accordance with an embodiment of the invention.
Figure 14:
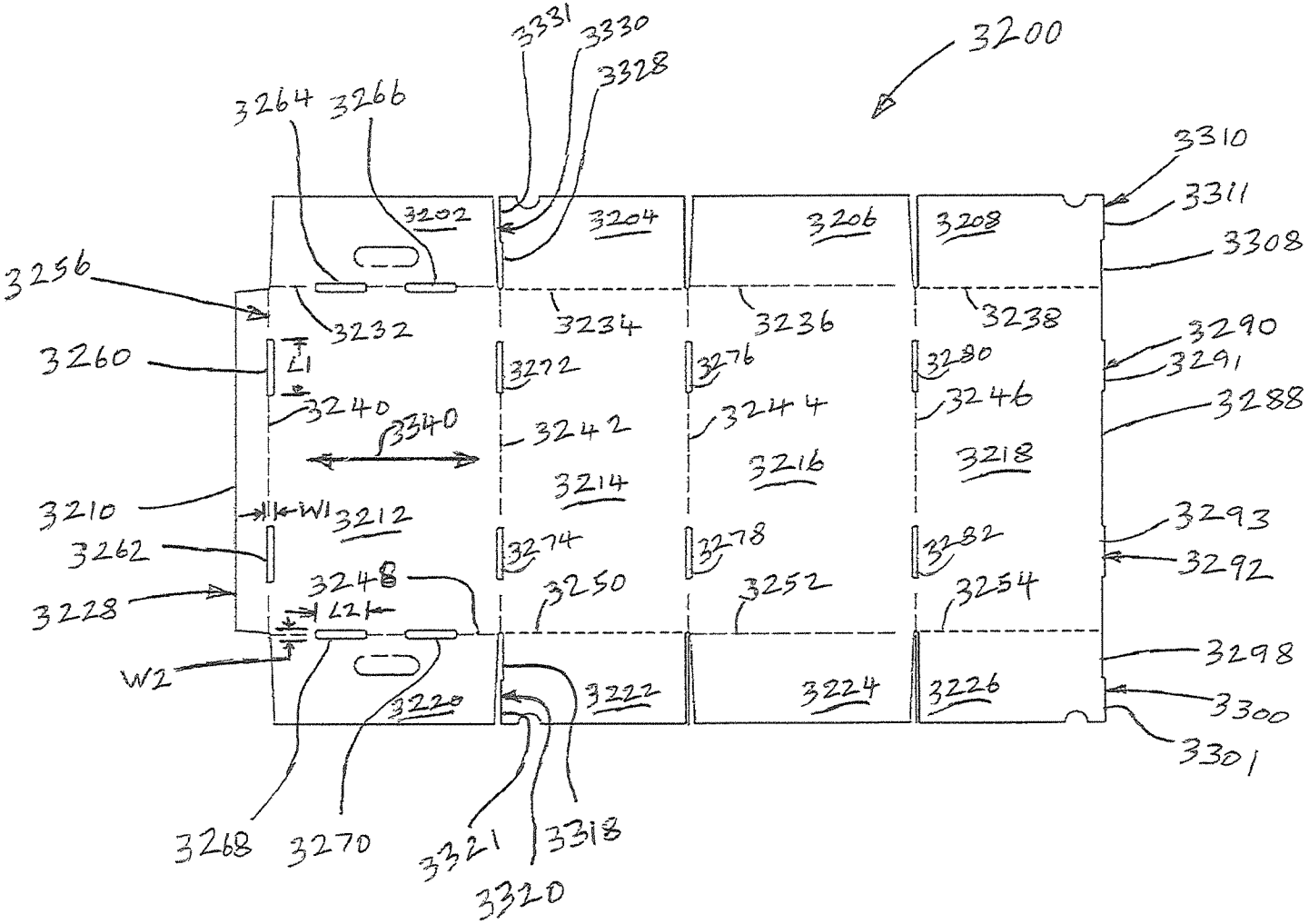
FIG. 14 depicts a plan view of a flat blank used to form the container depicted in FIG. 13, in accordance with an embodiment of the invention.
Figure 15:
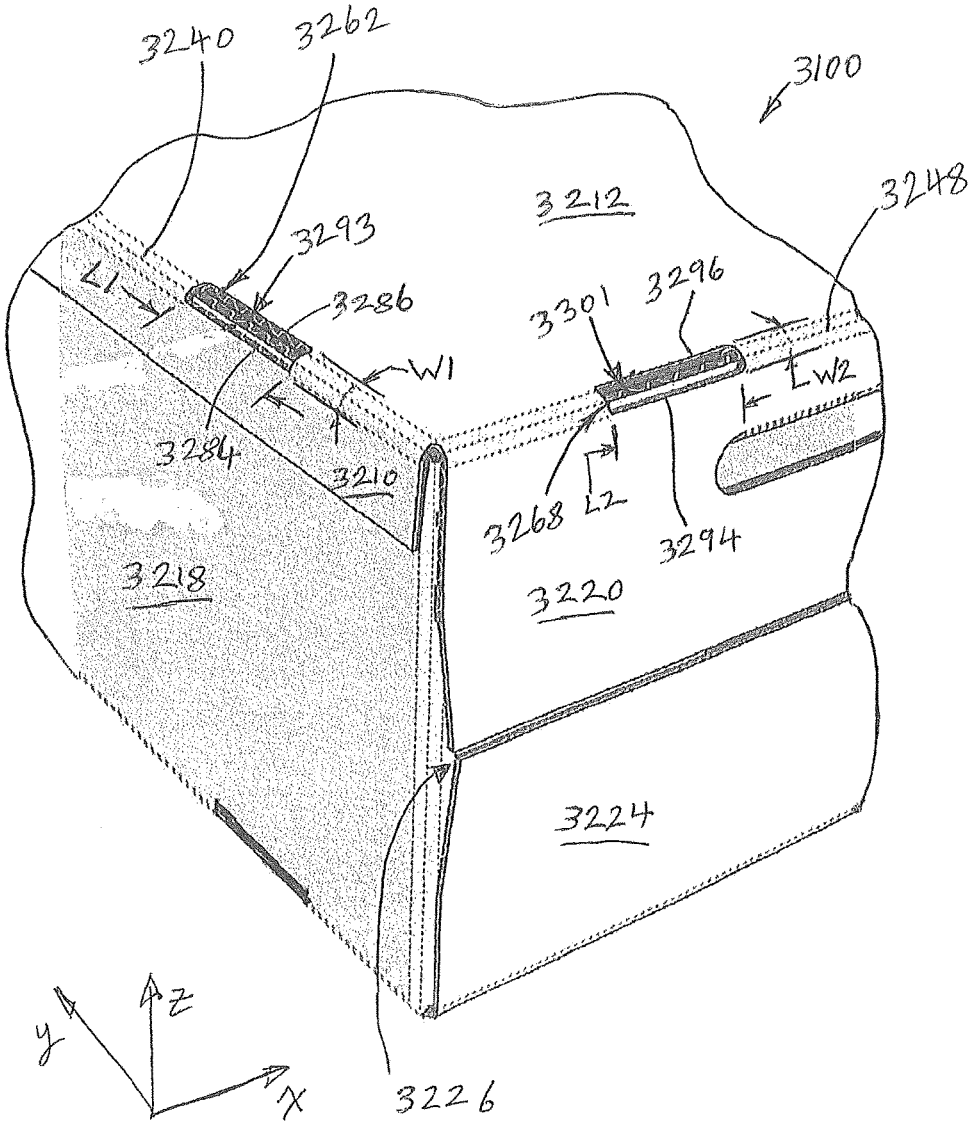
FIG. 15 depicts a perspective view of an enlarged portion of the container depicted in FIG. 13, in accordance with an embodiment of the invention.

Notwithstanding the foregoing, reference is now made to an embodiment of the invention depicted in FIGS. 13-15. As shown and described by FIGS. 13-15 and the accompanying text below, an alternative embodiment of the invention provides a reinforced packing container having compression reinforcement features (CRFs) provided in the form of slots, tabs, or a combination of slots and tabs, disposed at edges of the packing container. While embodiments described herebelow depict a wrap-around type container as an exemplary packing container constructed in accordance with and embodiment of the invention, it will be appreciated that the disclosed invention is also applicable to other types of packing containers, such as but not limited to slotted containers (SCs), regular slotted containers (RSCs), overlapped slotted containers (OSCs), or bliss style containers, for example, some of which having been described above in connection with FIGS. 1-12.

In addition to the foregoing description relating to FIGS. 1-12 where it was found that a CRF formed by removal or displacement of a small amount of the container sidewall material below an upper fold line (or above a lower fold line) on a side panel of the container, also herein referred to as a cutout region, can improve stacking strength (also herein referred to as compression strength, or box compression test (BCT) strength) of the associated container, it has also been found, in an embodiment of a container having one or more panels vertically oriented parallel with the z-axis, and with respect to the vertically oriented panel, that the inclusion of a small projection (discussed below in connection with FIGS. 13-15), provided by an integrally formed folded panel of the container, disposed within the cutout region can also improve the compression strength of the associated container. Such findings are supported by empirical experimentation and discussed further below.

Reference is now made to FIGS. 13-15.

FIG. 13 depicts an example container 3100 in accordance with an embodiment of the invention. FIG. 14 depicts a flat blank 3200 of the container 3100 of FIG. 13 in an unfolded state, where the solid lines represent through cut lines, and the dashed lines represent score lines and/or a succession of cut and uncut lines. Reference is now made to FIGS. 13 and 14 in combination. In an embodiment, the container 3100 includes a plurality of panels 3202, 3204, 3206, 3208, 3210, 3212, 3214, 3216, 3218, 3220, 3222, 3224, 3226 (herein collectively referred to by reference numeral 3228) having a defined material thickness integrally arranged with respect to each other and with respect to a set of orthogonal x, y and z axes, the z-axis defining a direction line in which the container is configured to support a stacking load. As used herein the term integrally arranged means arranged with respect to each other and formed from a single flat blank where connected adjacent panels are connected via a corresponding fold line 3232, 3234, 3236, 3238, 3240, 3242, 3244, 3246, 3248, 3250, 3252, 3254 (collectively herein referred to by reference numeral 3256) that may include a crease, a score, a cut, a succession of cut and uncut regions, a fold line, any combination of the foregoing, or any other means suitable for forming a fold line, as indicated by the dashed lines. The plurality of panels 3228 of the flat blank 3200 of FIG. 14 are folded at the plurality of fold lines 3256 to form the container 3100 of FIG. 13, which is herein referred to as a wrap-around container. As depicted in FIGS. 13 and 15, panel 3218 is folded inside of panel 3210, panels 3222, 3226 are folded inside of panels 3220, 3224, and panels 3204, 3208 are folded inside of panels 3202, 3206.

In a first embodiment in relation to FIGS. 13-15, the plurality of panels 3228 include a first panel 3210 having a first planar surface (not separately enumerated but understood to be the outer surface of panel 3210 as depicted in FIGS. 13 and 15, and herein referred to by reference numeral 3210), and a second panel 3212 having a second planar surface (not separately enumerated but understood to be the outer surface of panel 3212, and herein referred to by reference numeral 3212), where the second panel 3212 is disposed adjacent the first panel 3210, and where the first panel 3210 and the second panel 3212 form a contiguity with a fold line 3240 disposed therebetween. As illustrated, the first planar surface 3210 is disposed parallel to the y-z plane, however, rotation of the container 3100 about the z-axis will also permit the first planar surface 3210 to be disposed parallel to the x-z plane. Stated alternatively, the first planar surface 3210 is disposed parallel to the z-axis. As used herein, and in view of embodiments of the container 3100 being formed from a deformable material, and consistent with the description associated with FIGS. 1-12 above, the term "parallel" encompasses arrangements that are "generally parallel" or "substantially parallel". The fold line 3240 includes cutout regions 3260, 3262, best seen with reference to cutout region 3262 in FIG. 15, where FIG. 15 depicts a partial view of the container 3100 depicted in FIG. 13. Each cutout region 3260, 3262, with reference to cutout region 3262, has a first dimension "L1" that extends along the respective fold line 3240, and a second dimension "W1" that extends across the respective fold line 3240 from the first planar surface 3210 to the second planar surface 3212, such that the cut side edges 3284, 3286 of cutout region 3262 that are wholly contained with the respective first panel 3210 or second panel 3212 are sufficiently distant from the fold line 3240 so not to be unduly deformed by the folding process. In an embodiment, the aforementioned cut side edges 3284, 3286 form planar edges oriented perpendicular to the planar surfaces of the associated adjacent panels 3210, 3212. In an embodiment, the aforementioned cut edge 3284 located on the first panel 3210 forms a planar edge that is perpendicular to the z-axis. As used herein, and in view of embodiments of the container 3100 being formed from a deformable material, and also consistent with the description associated with FIGS. 1-12 above, the term "perpendicular" encompasses arrangements that are "generally perpendicular" or "substantially perpendicular".

In the first embodiment, and with reference to FIGS. 14 and 15, the plurality of panels 3228 further include a third panel 3218 having a third planar surface (not separately enumerated but understood to be the outer surface of panel 3218 as depicted in FIGS. 13 and 15, and herein referred to by reference numeral 3218), wherein the third panel 3218 has an outer edge 3288 having at least one projection 3290, 3292 that is contiguous and planar with the planar surface of panel 3218. The outermost cut edges 3291, 3293 of projections 3290, 3292 form planar edges having a thickness equal to the thickness of the panel material, and is oriented perpendicular to the planar surface of panel 3218 and perpendicular to the z-axis (best seen with reference to FIG. 15). In the folded state, and with reference to FIG. 15, the projections 3290, 3292, and more specifically the outermost cut edges 3291, 3293, are disposed within the respective cutout regions 3260, 3262 of container 3100. As depicted in FIGS. 13 and 15, the third planar surface of the third panel 3218 is oriented parallel with the first planar surface of the first panel 3210. And as depicted in FIG. 14, the second panel 3212, the third panel 3218, and two other panels 3214, 3216 of the plurality of panels 3228, form a contiguity having three fold lines 3242, 3244, 3246 that separate the third panel 3218 from the second panel 3212, where the three fold lines 3242, 3244, 3246 are oriented parallel with each other.

In a second embodiment in relation to FIGS. 13-15, the plurality of panels 3228 include a first panel 3220 having a first planar surface (not separately enumerated but understood to be the outer surface of panel 3220 as depicted in FIGS. 13 and 15, and herein referred to by reference numeral 3220), and a second panel 3212 having a second planar surface (not separately enumerated but understood to be the outer surface of panel 3212, and herein referred to by reference numeral 3212), where the second panel 3212 is disposed adjacent the first panel 3220, and where the first panel 3220 and the second panel 3212 form a contiguity with a fold line 3248 disposed therebetween. As illustrated, the first planar surface 3220 is disposed parallel to the x-z plane, however, rotation of the container 3100 about the z-axis will also permit the first planar surface 3220 to be disposed parallel to the y-z plane. Stated alternatively, the first planar surface 3220 is disposed parallel to the z-axis. The fold line 3248 includes cutout regions 3268, 3270, best seen with reference to cutout region 3268 in FIG. 15. Each cutout region 3268, 3270, with reference to cutout region 3268, has a first dimension "L2" that extends along the respective fold line 3248, and a second dimension "W2" that extends across the respective fold line 3248 from the first planar surface 3220 to the second planar surface 3212, such that the cut side edges 3294, 3296 of cutout region 3268 that are wholly contained with the respective first panel 3220 or second panel 3212 are sufficiently distant from the fold line 3248 so not to be unduly deformed by the folding process. In an embodiment, the aforementioned cut side edges 3294, 3296 form planar edges oriented perpendicular to the planar surfaces of the associated adjacent panels 3220, 3212. In an embodiment, the aforementioned cut edge 3294 located on the first panel 3220 forms a planar edge that is perpendicular to the z-axis.

In the second embodiment, and with reference to FIGS. 14 and 15, the plurality of panels 3228 further include a third panel 3226 having a third planar surface (not separately enumerated but understood to be the outer surface of panel 3226 as depicted in FIGS. 14 and 15, and herein referred to by reference numeral 3226), wherein the third panel 3226 has an outer edge 3298 having at least one projection 3300 that is contiguous and planar with the planar surface of panel 3226. The outermost cut edge 3301 of projection 3300 forms a planar edge having a thickness equal to the thickness of the panel material, and is oriented perpendicular to the planar surface of panel 3226 and perpendicular to the z-axis (best seen with reference to FIG. 15). In the folded state, and with reference to FIG. 15, projection 3300, and more specifically the outermost cut edge 3301, is disposed within the respective cutout region 3268 of container 3100. As depicted in FIGS. 13 and 15, the third planar surface of the third panel 3226 is oriented parallel with the first planar surface of the first panel 3220. And as depicted in FIG. 14, the second panel 3212, the third panel 3226, and three other panels 3214, 3216, 3218 of the plurality of panels 3228, form a contiguity having four fold lines 3242, 3244, 3246, 3254 that separate the third panel 3226 from the second panel 3212, where three 3242, 3244, 3246 of the four fold lines are oriented parallel with each other, and one of the fourth fold line 3254 is oriented perpendicular to the three parallel oriented fold lines 3242, 3244, 3246.

With reference to FIGS. 13 and 14, it will be appreciated that the aforementioned description of the second embodiment also applies to an alternative second embodiment where the "first panel" is panel 3202, the "third panel" is panel 3208, the "fold line" is fold line 3232, the "cutout regions" are cutout regions 3264, 3266, the "cut side edges" of cutout region 3264 are similar to the cut side edges 3294, 3296 of cutout region 3268, the "outer edge" is outer edge 3308, the "at least one projection" is projection 3310, the "outermost cut edge" is outermost cut edge 3311, the "four fold lines" are fold lines 3242, 3244, 3246, 3238, and the "fourth fold line" is fold line 3238. In this alternative second embodiment, the projection 3310, and more specifically the outermost cut edge 3311, is disposed within the respective cutout region 3264 of container 3100.

In a third embodiment in relation to FIGS. 13-15, the plurality of panels 3228 include a first panel 3220 and a second panel 3212 arranged as described in the aforementioned second embodiment, and where the description for cutout region 3268 also applies to cutout region 3270.

In the third embodiment, and with reference to FIGS. 13 and 14, the plurality of panels 3228 further include a third panel 3222 having a third planar surface (not separately enumerated but understood to be the outer surface of panel 3222 as depicted in FIGS. 13 and 14, and herein referred to by reference numeral 3222), wherein the third panel 3222 has an outer edge 3318 having at least one projection 3320 that is contiguous and planar with the planar surface of panel 3222. The outermost cut edge 3321 of projection 3320 forms a planar edge having a thickness equal to the thickness of the panel material, and is oriented perpendicular to the planar surface of panel 3222 and perpendicular to the z-axis (best seen with reference to FIG. 13). In the folded state, and with reference to FIG. 13, projection 3320, and more specifically the outermost cut edge 3321, is disposed within the respective cutout region 3270 of container 3100 (in a manner similar to how the outermost cut edge 3301 of projection 3300 is disposed within the respective cutout region 3268, discussed above in connection with the second embodiment). As depicted in FIG. 13, the third planar surface of the third panel 3222 is oriented parallel with the first planar surface of the first panel 3220. And as depicted in FIG. 14, the second panel 3212, the third panel 3222, and one other panel 3214 of the plurality of panels 3228, form a contiguity having two fold lines 3242, 3250 that separate the third panel 3222 from the second panel 3212, where the two fold lines 3242, 3250 are oriented perpendicular to each other.

With reference to FIGS. 13 and 14, it will be appreciated that the aforementioned description of the third embodiment also applies to an alternative third embodiment where the "first panel" is panel 3202, the "third panel" is panel 3204, the "fold line" is fold line 3232, the "cutout regions" are cutout regions 3264, 3266, the "cut side edges" of cutout region 3266 are similar to the cut side edges 3294, 3296 of cutout region 3268, the "outer edge" is outer edge 3328, the "at least one projection" is projection 3330, the "outermost cut edge" is outermost cut edge 3331, and the "two fold lines" are fold lines 3242, 3234. In this alternative third embodiment, the projection 3330, and more specifically the outermost cut edge 3331, is disposed within the respective cutout region 3266 of container 3100.

In an embodiment, projections 3290, 3292, 3300, 3310, 3320, 3330 extend outward from a respective outer edge 3288, 3298, 3308, 3318, 3328 no more than the thickness of the material of the flat blank 3200.

With reference to each of the first, second and third embodiments described above, panel 3210 may be secured to panel 3218 via a glue strip, an adhesive liquid, an adhesive tape, or mechanical fasteners. Also, the plurality of panels 3228 may be formed from a flat blank of corrugated material having a defined direction of corrugation as indicated by line 3340, where each planar edge of the outermost cut edges 3291, 3293, 3301, 3311, 3321, 3331 are oriented perpendicular to the direction of corrugation 3340. In the first embodiment described above, the fold line 3240 is oriented perpendicular to the direction of corrugation 3340, while in the second and third embodiments described above, the respective fold lines 3248, 3232 are oriented parallel with the direction of corrugation 3340.

With reference to the first embodiment described above, the plurality of panels 3228 includes a fourth panel 3214 and a fifth panel 3216, where the fourth panel 3214 has a fourth planar surface oriented parallel with the first planar surface of the first panel 3210. The second panel 3212, the fourth panel 3214, the fifth panel 3216 and the third panel 3218 form a contiguity with a second fold line 3242, a third fold line 3244 and a fourth fold line 3246 disposed therebetween. In an embodiment, at least one of the second fold line 3242, third fold line 3244 and fourth fold line 3246 has one or more respective cutout regions 3272, 3274, 3276, 3278, 3280, 3282, where each cutout region extends along the respective fold line in a first direction and across the respective fold line in a second direction, and where each cutout region has a planar edge oriented perpendicular to the fourth planar surface of the fourth panel 3214, parallel with the fifth planar surface of the fifth panel 3216 and perpendicular to the z-axis, similar to the arrangement discussed above in connection with cutout regions 3262, 3268.

With reference to the second and third embodiments described above, a similar arrangement for the fourth and fifth panels 3214, 3216 is depicted in FIGS. 13-15, but where the fourth panel 3214 is oriented perpendicular to the first panel 3220.

In view of the foregoing description of container 3100, and with consideration being given to the container 3100 not being limited to just a wrap-around style container, it will be appreciated that an embodiment of the invention can alternatively described as follows.

In an embodiment, container 3100 includes a plurality of panels 3228 having a defined thickness integrally arranged with respect to each other and with respect to a set of orthogonal x, y and z axes, the z-axis defining a direction line in which the container 3100 is configured to support a stacking load. The plurality of panels 3228 are folded with respect to each other to define a form having a plurality of folded edges 3232, 3240, 3248 oriented perpendicular to the z-axis, where at least one of the plurality of folded edges has a cutout region 3260, 3262, 3264, 3266, 3268, 3270 having a planar edge, similar to planar edges 3284, 3294 depicted in FIG. 15, oriented perpendicular to the z-axis. The plurality of panels 3228 include a plurality of cut edges 3288, 3298, 3308, 3318, 3328 oriented and disposed inline with respective ones 3240, 3232, 3248 of the plurality of folded edges, where respective ones of the plurality of cut edges include a projection 3290, 3292, 3300, 3310, 3320, 3330 disposed contiguous and planar with a respective panel 3218, 3226, 3208, 3222, 3204 of the plurality of panels 3228. In a folded state, each projection has a planar edge, similar to planar edges 3293, 3301 depicted in FIG. 15, oriented perpendicular to the z-axis, where each planar edge is disposed within an adjacently disposed cutout region. The plurality of panels 3228 connected via the plurality of fold lines 3256 form a contiguity, as illustrated by the flat blank 3200 of FIG. 14. Other folded edges 3242, 3244, 3246 of the plurality of folded edges 3256 include other cutout regions 3272, 3274, 3276, 3278, 3280, 3282 each having a planar edge, similar to planar edges 3284, 3294 described above, oriented perpendicular to the z-axis. With respect to these other folded edges 3242, 3244, 3246, the associated cutout regions 3272, 3274, 3276, 3278, 3280, 3282 do not have a planar edge of a projection disposed within them. That is, cutout regions 3260, 3262, 3264, 3266, 3268, 3270 are paired up with respective ones of projections 3290, 3292, 3310, 3330, 3300, 3320, while cutout regions 3272, 3274, 3276, 3278, 3280, 3282 are not so paired. As illustrated in FIG. 14, folded edge 3240 includes cutout regions 3260, 3262, folded edge 3232 includes cutout regions 3264, 3266, and folded edge 3248 includes cutout regions 3268, 3270, where folded edges 3232, 3248 are parallel with each other and perpendicular to folded edge 3240.

While certain combinations of panels 3202, 3204, 3206, 3208, 3210, 3212, 3214, 3216, 3218, 3220, 3222, 3224, 3226, fold lines 3232, 3234, 3236, 3238, 3240, 3242, 3244, 3246, 3248, 3250, 3252, 3254, cutout regions 3260, 3262, 3264, 3266, 3268, 3270, 3272, 3274, 3276, 3278, 3280, 3282, and projections 3290, 3292, 3300, 3310, 3320, 3330, have been described herein, it will be appreciated that these certain combinations are for illustration purposes only and that any combination of any of the foregoing panels, fold lines, cutout regions, and projections may be employed in accordance with an embodiment of the invention. For example, cutout regions 3260 and/or 3262 along with projections 3290 and/or 3293, may be employed with or without any other herein described cutout region or projection, and cutout regions 3264, 3266, 3268 and/or 3270 along with projections 3310, 3330, 3300 and/or 3320, may be employed with or without any other cutout region or projection herein described in connection with FIGS. 13-15. Any and all such combinations are contemplated herein and are considered within the scope of the invention disclosed. Accordingly, the flat blank 3200 of FIG. 14, along with the perspective views of the container 3100 of FIGS. 13 and 15, are considered representative of many embodiments having all, none or just a select grouping of the aforementioned cutout regions and projections, consistent with the disclosure herein.

Relative to a container 3100 having no cutout regions or projections as herein described, that is, absent any cutout regions on fold lines with planar cut edges of projections nested therein, empirical data has shown that an embodiment of container 3100 having only cutout regions 3260, 3262, 3264, 3266, 3268, 3270 with projections 3290, 3292, 3310, 3330, 3300, 3320 respectively nested therein, has an increased BCT strength of about 5.5%, and when cutout regions 3272, 3274, 3276, 3278, 3280, 3282 are additionally included, empirical data has shown that the same embodiment of container 3100 has an increased BCT strength of about 20.5%. Additionally, and also relative to a container 3100 having no cutout regions or projections as herein described, empirical data has shown that an embodiment of container 3100 having only cutout regions 3272, 3274, 3276, 3278, 3280, 3282, with no projections nested therein, has an increased BCT strength of about 6.5%. Accordingly, and while not being held to any particular theory, empirical data has shown that combining cutout regions 3260, 3262, 3264, 3266, 3268, 3270 and projections 3290, 3292, 3310, 3330, 3300, 3320 with cutout regions 3272, 3274, 3276, 3278, 3280, 3282, a synergistic effect results, that is, the combined BCT strength increase is greater than the sum of the separate BCT strength increases. The above-noted empirical data is based on a wrap-around style container 3100 similar to that depicted in FIGS. 13-15 formed from a three-ply corrugated sheet product material with the outer plies having a 42-pound board weight, and the center ply being a C-flute having a 33-pound board weight.

While certain combinations of features relating to a container, or flat blank for a container, have been described herein, it will be appreciated that these certain combinations are for illustration purposes only and that any combination of any of these features may be employed, explicitly or equivalently, either individually or in combination with any other of the features disclosed herein, in any combination, and all in accordance with an embodiment of the invention. Any and all such combinations are contemplated herein and are considered within the scope of the invention disclosed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. Also, in the drawings and the description, there have been disclosed example embodiments of the invention and, although specific terms may have been employed, they are unless otherwise stated used in a generic and descriptive sense only and not for purposes of limitation, the scope of the invention therefore not being so limited. Moreover, and unless otherwise stated, the use of the terms first, second, etc. do not denote any order or importance, but rather the terms first, second, etc. are used to distinguish one element from another. Furthermore, and unless otherwise stated, the use of the terms a, an, etc. do not denote a limitation of quantity, but rather denote the presence of at least one of the referenced item.

What is claimed is:

1. A container, comprising:

a plurality of panels having a defined thickness integrally arranged with respect to each other and with respect to a set of orthogonal x, y and z axes, the z-axis defining a direction line in which the container is configured to support a stacking load;

wherein the plurality of panels comprise a first panel comprising a first planar surface, and a second panel comprising a second planar surface, wherein the second panel is disposed adjacent the first panel, wherein the first panel and the second panel form a contiguity with a fold line disposed therebetween, wherein the first planar surface is disposed parallel to the x-z plane or the y-z plane, wherein the fold line comprises at least one cutout region having a first dimension that extends along the fold line and a second dimension that extends across the fold line from the first planar surface to the second planar surface, wherein the at least one cutout region comprises a first planar edge oriented perpendicular to the first planar surface and perpendicular to the z-axis;

wherein the plurality of panels further comprise a third panel comprising a third planar surface disposed parallel with the first planar surface, wherein the third panel comprises an outer edge having at least one projection that is contiguous and planar with the third planar surface, wherein the at least one projection comprises a second planar cut edge oriented perpendicular to the third planar surface and perpendicular to the z-axis;

wherein the second panel, the third panel, and two other panels of the plurality of panels, form a contiguity having three fold lines that separate the third panel from the second panel, wherein the three fold lines of the contiguity are oriented parallel with each other;

wherein the at least one projection is disposed within a respective one of the at least one cutout region; and wherein the at least one projection extends outward from the respective outer edge no more than the defined thickness of the plurality of panels;

wherein the plurality of panels further comprise a first side panel contiguous with the second panel and with a first side fold line therebetween, the first side fold line comprising at least one cutout region;

wherein the plurality of panels further comprise a second side panel contiguous with the third panel and with a second side fold line therebetween, the second side panel comprising an outer edge having a projection that is contiguous and planar with the second side panel;

wherein the projection of the second side panel is disposed within the at least one cutout region of the first side fold line and extends outward from the respective outer edge no more than the defined thickness of the plurality of panels.

2. The container of claim 1, wherein the first panel is secured to another one of the plurality of panels disposed adjacent the first panel.

3. The container of claim 1, wherein the plurality of panels are formed from a flat blank of corrugated material having a defined direction of corrugation, and wherein the second planar edge is oriented perpendicular to the direction of corrugation.

4. The container of claim 1, wherein the plurality of panels are formed from a flat blank of corrugated material having a defined direction of corrugation, and wherein the fold line is oriented perpendicular to the direction of corrugation.

5. The container of claim 1, wherein the plurality of panels are formed from a flat blank of corrugated material having a defined direction of corrugation, and wherein the fold line is oriented parallel with the direction of corrugation.

6. The container of claim 1, wherein the plurality of panels comprise a fourth panel comprising a fourth planar surface oriented parallel with the first planar surface, wherein the second panel and the fourth panel form a contiguity with a second fold line disposed therebetween, wherein the second fold line comprises at least one second cutout region that extends along the second fold line in one direction and across the second fold line in another direction, wherein the at least one second cutout region comprises a third planar edge oriented perpendicular to the fourth planar surface and perpendicular to the z-axis.

7. The container of claim 6, wherein the plurality of panels comprise a fifth panel comprising a fifth planar surface oriented parallel with the second planar surface and perpendicular to the fourth planar surface, wherein the fourth panel and the fifth panel form a contiguity with a third fold line disposed therebetween, wherein the fifth panel and the third panel form a contiguity with a fourth fold line disposed therebetween, wherein at least one of the third fold line and the fourth fold line comprises at least one third cutout region that extends along the respective fold line in one direction and across the respective fold line in another direction, wherein the at least one third cutout region comprises a fourth planar edge oriented parallel with the fifth planar surface and perpendicular to the z-axis.

8. The container of claim 1, wherein the plurality of panels comprise a fourth panel comprising a fourth planar surface oriented perpendicular with the first planar surface, wherein the second panel and the fourth panel form a contiguity with a second fold line disposed therebetween, wherein the second fold line comprises at least one second cutout region that extends along the second fold line in one direction and across the second fold line in another direction, wherein the at least one second cutout region comprises a third planar edge oriented perpendicular to the fourth planar surface and perpendicular to the z-axis.

9. The container of claim 8, wherein the plurality of panels comprise a fifth panel comprising a fifth planar surface oriented parallel with the second planar surface and perpendicular to the fourth planar surface, wherein the fourth panel and the fifth panel form a contiguity with a third fold line disposed therebetween, wherein the third fold line comprises at least one third cutout region that extends along the third fold line in one direction and across the third fold line in another direction, wherein the at least one third cutout region comprises a fourth planar edge oriented parallel with the fifth planar surface and perpendicular to the z-axis.

10. A container, comprising:

a plurality of panels having a defined thickness integrally arranged with respect to each other and with respect to a set of orthogonal x, y and z axes, the z-axis defining a direction line in which the container is configured to support a stacking load;

wherein the plurality of panels is folded to define a form having a plurality of folded edges oriented perpendicular to the z-axis;

wherein at least one of the plurality of folded edges comprises a cutout region comprising a planar edge oriented perpendicular to the z-axis;

wherein the plurality of panels comprises a plurality of cut edges oriented and disposed inline with respective ones of the plurality of folded edges;

wherein at least one of the plurality of cut edges comprises a projection disposed contiguous and planar with a respective panel of the plurality of panels;

wherein the projection comprises a planar cut edge oriented perpendicular to the z-axis, the planar cut edge being disposed within an adjacently disposed cutout region;

wherein the plurality of panels form a contiguity;

wherein the projection and the cutout region are disposed relative to one another on the contiguity separated by three fold lines that are oriented parallel with each other;

wherein the projection extends outward from the respective cut edge no more than the defined thickness of the plurality of panels; and wherein at least another one of the plurality of folded edges comprises a second cutout region comprising a planar edge oriented perpendicular to the z-axis, wherein the planar cut edge of another projection is not disposed within the second cutout region;

further wherein at least two of the plurality of folded edges comprises a cutout region comprising a planar edge oriented perpendicular to the z-axis;

further wherein at least two of the plurality of cut edges comprises a projection disposed contiguous and planar with a respective panel of the plurality of panels;

further wherein each corresponding projection comprises a planar cut edge oriented perpendicular to the z-axis, the corresponding planar cut edge being disposed within an adjacently disposed corresponding cutout region.

11. The container of claim 10, wherein the plurality of folded edges comprises a first edge, and a second edge adjacent to and perpendicular to the first edge, wherein the first edge and the second edge each comprises at least one of the respective cutout regions with at least one of the respective projections disposed therein.

* * * * *